US006827379B2

(12) United States Patent
Hill et al.

(10) Patent No.: US 6,827,379 B2
(45) Date of Patent: Dec. 7, 2004

(54) QUICK MOUNTING CLIP SYSTEM FOR HANGING DECORATIONS AND CHRISTMAS LIGHTS

(75) Inventors: Thomas R. Hill, Flippin, AR (US); Wesley Due, Flippin, AR (US); Dennis Shrable, Flippin, AR (US); James Dilday, Flippin, AR (US); William Redifer, Mountain Home, AR (US); David S. Burleigh, Yellville, AR (US); Raymond Diehl, Mountain Home, AR (US); Hank Tiley, Mountain Home, AR (US); Harry R. Froit, Flippin, AR (US)

(73) Assignee: Micro Plastics, Inc., Flippin, AR (US)

( * ) Notice: Subject to any disclaimer, the term of this patent is extended or adjusted under 35 U.S.C. 154(b) by 79 days.

(21) Appl. No.: 10/303,332

(22) Filed: Nov. 25, 2002

(65) Prior Publication Data

US 2003/0094822 A1 May 22, 2003

Related U.S. Application Data

(63) Continuation-in-part of application No. 09/993,983, filed on Nov. 16, 2001, now Pat. No. 6,659,521.

(51) Int. Cl.[7] ..... A47F 13/06; A47B 96/06

(52) U.S. Cl. ..... 294/19.1; 294/24; 248/205.3; 248/231.81

(58) Field of Search ..... 294/19.1, 22, 24, 294/26; 248/205.3, 222.11, 228.7, 231.81, 320; 24/457

(56) References Cited

U.S. PATENT DOCUMENTS

| | | | | |
|---|---|---|---|---|
| 3,181,827 A | | 5/1965 | Sassin | |
| 3,193,229 A | | 7/1965 | Stock | |
| 3,540,687 A | | 11/1970 | Cuva | |
| 3,599,916 A | | 8/1971 | Szabo | |
| 3,599,918 A | | 8/1971 | Datchett | |
| 3,936,088 A | * | 2/1976 | Williams | 294/19.1 |
| 4,905,131 A | | 2/1990 | Gary | |
| 5,056,747 A | | 10/1991 | Kireta | |
| D325,866 S | | 5/1992 | Gary | |
| 5,141,192 A | * | 8/1992 | Adams | 248/231.81 |
| D356,246 S | | 3/1995 | Adams | |
| 5,496,005 A | | 3/1996 | Dieringer | |
| 5,542,636 A | * | 8/1996 | Mann et al. | 248/229.26 |
| 5,560,975 A | | 10/1996 | Casper | |
| 5,566,058 A | | 10/1996 | Protz, Jr. | |
| D376,535 S | | 12/1996 | Gary | |
| D414,241 S | | 9/1999 | Burchard et al. | |
| 5,964,489 A | | 10/1999 | Mahoney | |
| D427,510 S | | 7/2000 | Gary et al. | |
| 6,352,291 B1 | | 3/2002 | Tortajada | |
| 6,425,614 B1 | * | 7/2002 | Limber et al. | 294/24 |

* cited by examiner

*Primary Examiner*—Dean J. Kramer
(74) *Attorney, Agent, or Firm*—Steven D. Carver

(57) ABSTRACT

Apparatus for deploying decorative wiring upon elevated locations. The apparatus, packaged in kit form, utilizes a pole for installing wiring from a stable ground position. An installation nut screws unto the pole for manipulating accessory tools that deploy the clips and wiring. The nut comprises captivating slots to which a clip controller and wire tool are alternately coupled. A prong projecting from the controller forcibly engages the wiring clips. After clip installation, wires are installed with the wire tool's arms. The controller and wire tool both comprise flexible legs fitted within the nut slots that are snap-fitted by detents. Each clip comprises a baseplate, and an outwardly angled cradle for holding wiring. The gutter clip has a projecting latch terminating in a gutter-engaging barb. The adhesively-backed clip is press fitted to the target. A control region formed between the cradle and the baseplate of each clip receives the controller prong.

32 Claims, 26 Drawing Sheets

QUICK MOUNTING CLIP SYSTEM FOR HANGING DECORATIONS AND CHRISTMAS LIGHTS

CROSS REFERENCE TO RELATED APPLICATION

This application is a continuation in part of a previously filed, United States utility patent application entitled "Suspension Ceiling Clips and Installation Method," Ser. No. 09/993,983, filed Nov. 16, 2001, now U.S. Pat. No. 6,659,521 and owned by the same assignee as in this case.

BACKGROUND OF THE INVENTION

1. Field of the Invention

Our invention relates generally to systems for suspending and supporting decorations including strings of Christmas lights or other miscellaneous objects from elevated structures including residential dwellings, office buildings, and the like. More particularly, the invention relates to a system preferably used for hanging strings of decorative lights with multiple, resilient support clips that are remotely quick-fitted to structures such as gutters or the like, and which includes appropriate hand-operated installation apparatus for manipulating the clips and installing the wiring from the ground. Known prior art systems that are pertinent to the invention can be found in United States Patent Class 248, Subclasses 74.2, 223.41; Class 294, Subclass 24; Class 362 Subclass 396; and Class 428, Subclass 99.

2. Description of the Related Art

Outdoor lighting displays are quite popular during major holidays such as Christmas. Both commercial and non-commercial light displays involving diverse designs, colors and features are becoming increasingly common. Displays of multi-colored lights take on a variety of forms, and they may be applied to trees, shrubbery, exterior portions of buildings, signs, posts and other miscellaneous structures. Most residential, decorative lighting displays are temporary. Homeowners commonly install desired chains of colored lights before or slightly after the Thanksgiving Holiday, and then remove them after New Years Day. Many retail establishments, including specialty stores and smaller shops, also use temporary decorative lights on a seasonal basis. However, the popularity and complexity of vivid, colorful lighting displays is increasing—displays are often erected for other occasions, such as the Fourth of July, Halloween etc. Considerable electrical lengths of decorative wiring are frequently suspended along the roofline of residences. For example, it is common to attach strings of lights to gutters at the roof edges. Quite often, extension ladders are used by the installer to reach these elevated and otherwise inaccessible places. Installation can be difficult, time consuming, and vexatious. Possible detrimental weather conditions during the winter months aggravate installation problems.

Concurrently, large-scale light displays involving hundreds or thousands of lights are becoming increasingly popular. Gigantic displays, involving substantial creativity and artistic input, necessitate multiple electrical strands, each with bulbs of varying colors, sizes, and intensity. The installation of huge displays engenders extra effort, as lines of lights are often arranged and rearranged by "trial and error" methods to achieve the desired aesthetic impression. Where multiple, alternative configurations are deployed, the work effort increases dramatically, as strings of lights may be deployed, evaluated, and then taken down for adjustments and redeployment in alternative configurations. The efficiency of the installation and removal processes is critical.

Access to suitable support structures, including residential gutters, trees, and the like is often difficult. Extension ladders are heavy and cumbersome to handle. Commercial scaffolding arrangements are time consuming and often too expensive to use. Improper use of smaller stepladders or stools invite accident and injury. Not surprisingly, hand tools with elongated handles that facilitate installation of decorative lights from the ground or floor have previously been developed.

For example, U.S. Pat. No. 5,560,975, issued Oct. 1, 1996, discloses a pole-operated system for installing decorative lights upon elevated structures while the operator stays on the ground. Decorative strings of lights are manipulated by an adaptor suspended from and controlled by an elongated pole. Resilient "hooks" are removably installed upon structure to be decorated to hold strands of bulbs. A finger projecting from the adaptor penetrates a ring that is integral with each hook to aid in handling and installation. Legs emanating from each hook ring facilitate engagement of the hook upon tree branches, roof gutter structure, or the like. Each hook has a curved, lower lip that removably supports the decorative wiring once the hook is deployed.

Similarly, U.S. Pat. No. 5,964,489 issued Oct. 12, 1999 shows a pole-operated hook structure that facilitates the placement of decorations, including ornaments or decorative light strands. The pole controls a unique hook that enables manipulation of both the ornament and wire to be installed, and the elevated support structure that will hold it.

U.S. Pat. No. 6,352,291 issued Mar. 5, 2002 depicts another system for remotely affixing and removing decorative strands of lights upon a roof, a gutter, a tree, etc. An elongated pole-like implement supports a remote, U-shaped cradle that manipulates wire strands. A downwardly oriented hook facilitates proper positioning of the wiring. Temporary hangers or clips are used to support the wiring.

Other analogous pole-controlled systems for installing decorative lighting or other ornaments are seen in U.S. Pat. Nos. 5,713,617, 6,227,584, and 6,425,614. In addition, analogous pole-operative tools for mounting various items to suspended ceilings are seen in U.S. Pat. Nos. 4,135,692, 5,052,733, 5,188,332, 5,267,764, 5,247,725, 5,632,519, 5,938,255, and 6,048,010.

Finally, numerous resilient clips for supporting strands of decorative lights are known in the art. These diverse designs presumably may be manipulated and installed with or without special manipulating poles similar to those described above. In this regard attention is directed to U.S. Utility Pat. Nos. 3,181,827, 3,193,229, 3,438,604, 3,540,687, 3,599,916, 3,599,918, 4,905,131, 5,056,747, 5,388,802, 5,496,005, 5,566,058, and 5,581,956. Furthermore, resilient clips of this general character are illustrated in U.S. Design Pat. Nos. D325,866, D356,246, D376,535, D414,291, and D427,510.

Known installation tools for erecting strands of decorative lights have several disadvantages. For one thing, roof designs are of varying dimensions and configurations, and many differently shaped gutters exist. In other words, the vertical cross-sections of different residential gutters can vary, complicating the required design for any clip or hook that is to be snap-fitted to the gutter. While "universal" clips have been proposed in the art, some gutters are sufficiently different from the norm that available clips will not easily "snap-fit" to the gutter structure for a stable mount. Thus, even when affixed to available edge portions of the gutter or roofline, some clips do not assume a desired, uniform orientation. On the other hand, some buildings are not equipped with gutters at all. Clips designed with resilient fingers or prongs or legs that are designed to resiliently snap-fit to available structure often cannot be deployed upon available, flat surfaces. Furthermore, the efficiency of known application tools used to install prior art "clips" or "hooks" to irregular surfaces or structures is low. Another problem is that conventional, pole-operated clip-installation tools are insufficiently dexterous to remove clips or hooks that have been forcibly installed upon irregular structures or surfaces for which they were not designed. As a result, some clips cannot be easily removed while the user stands in a safe position on the ground.

Another problem is that the higher one tries to reach, the more difficult it can become to manipulate a hand tool. Tools having moving parts such as compressible jaws or the like require substantial activation forces. This makes it difficult to manipulate or remove a wire-mounting clip, or the wiring held thereby, when working at maximum elevations. Another problem is that some prior art tools are incomplete, forcing the installer to use various hand tools in addition to the clips and parts already required.

In a typical situation where the installer cannot reach the tallest part of the structure upon which the lights are to be installed, one must use a ladder or other elevating structure. Of course, the closer to ground that the user stands, the more stable is his or her support. Thus, adequate installing systems must enable the user to remain stably supported as close to the ground as possible. Furthermore, valuable time is lost when, because of the inaccessible orientation of the structure to be decorated, the user's stand or stool must be frequently repositioned to enable access to target regions being decorated. A suitable system must readily facilitate access to as wide a region to be decorated as possible, to minimize the number of times that the stool or other stand must be repositioned.

Thus a rapidly deployable pole and clip system that accommodates vastly different applications, including roofs, gutters, and other structures of varying dimensions, elevations, and configurations is highly advantageous.

Such a system must include clips of appropriate configurations and dimensions to handle those real-world applications that are likely to be encountered in the field. The installation tools must reliably and non-destructively handle not only the suspension clips, but the wiring strands and lights to be erected. Furthermore, the clips must be readily capable of removal. Of course the installation tool must adequately enable disassembly—hard to reach clips that are to be removed should be easily "snapped" out of engagement with the gutter where desired. Suitable clips must be inexpensive and lightweight, and at the same time, strong and dependable. The use of complex metallic tools with compound parts should be avoided. Finally, the entire system must be readily capable of dependable and safe use by a single person standing as close as possible to the ground, without dangerously overextending himself or herself upon a step stool or the like.

Resilient, preferably plastic clips and tools that accomplish these goals, and an apparatus and method for installing and/or removing them, are proposed.

BRIEF SUMMARY OF THE INVENTION

Our invention comprises a system broadly adapted for deploying decorative strands of lighting from elevated objects or structures such as roof lines, gutters or the like. The preferred system, adapted to be packaged and sold as a kit, enables decorative lighting strings to be installed (and then removed) by a single person safely and efficiently from a stable position as close as possible to the ground. Our system is ideal for installing Christmas lights, but numerous other items including various forms of decorations and/or electrical wiring can be easily mounted upon available structures. Installation is readily accomplished without deploying cumbersome extension ladders, scaffolding, or heavy, unwieldy lifting equipment.

Our system uses a conventional, elongated pole for remotely accessing elevated objects or locations to be decorated. The other parts are injection molded from plastic. An installation nut screws onto the pole for remotely manipulating our accessory tools that control and deploy our wire-holding clips. One of our quick-connect tools is specially designed to control our wire-holding clips during installation. Another system accessory tool strings the decorative wiring amongst previously deployed clips, and manipulates the decorative wiring for removal. Two different wire-clip designs are provided. One gutter clip snap fits to conventional, residential rain gutters to suspend decorative wiring. We also provide a "peel-and-stick" adhesive clip for applications lacking gutters. The adhesive clips are pressed against and thus stuck to available flat surfaces.

The preferred, two-piece steel pole is extensible, and it terminates in a suitable thread, similar to a common ACME thread. Many common household, metal or wooden poles like those used with mops, rakes, brooms or the like will work with our system, as long as the pole terminates in a suitable thread for quick, threadable connection to our preferred installation nut. The pole-mounted installation nut provides a means for quick connecting the various accessory tools that deploy our clips and/or manipulate decorative light strands. The preferred installation nut resembles a cylindrical barrel in shape. Opposite, spaced apart sides of the nut comprise receptacles to which preferred system accessory tools "quick-connect". Preferably the nut receptacles have elongated, captivating slots to which the accessory tools are releasably coupled, without the need for hand tools or the like. Alternatively, the accessory tools may be threadably coupled to nut top through a suitable orifice.

Our wire-holding clips are preferably deployed upon or adjacent elevated locations with our preferred, clip controller. The resilient clip controller, shaped generally like a question mark, has an upper, outwardly-projecting, horizontal prong for temporarily penetrating and releasably engaging wiring clips to be installed. The lower, vertical portion of the controller comprises a pair of flexible, parallel legs. These legs are spaced apart from each other across a channel that facilitates flexing. To install the controller, the legs are inserted into the installation nut receptacle channel, and the two parts are simply pushed together. When the controller's legs slide down far enough within the channel, special detents that are integral with the legs emerge from the nut. After the legs snap apart slightly, the detents yieldably captivate the controller within the installation nut.

After the controller is snap-fitted to the nut, the controller prong may be temporality pressed into engagement with a chosen clip. With the help of the pole, clips are lifted to a desired location for installation, and oriented properly for application. Gutter clips moved into a position proximate a gutter may be snap fitted to its edges; adhesive clips may be simply pressed upon a desired flat surface. After a clip is installed, sideways movement of the clip controller will disassociate it from a clip as its prong withdraws. Installed gutter clips, which will remain firmly attached, may later be removed by a reversal of the process.

Once the clips are pre-installed, the wiring strands may be deployed. Our special wire controller tool mounts to the pole and installation nut the same way the clip controller does. First, the clip controller is removed by pinching the legs together, clearing its integral leg detents, and then pulling the controller and it apart. The wire tool is then installed. Preferably, it comprises an elongated, body with a pair of upper, arcuate arms. One arm has an upwardly facing recess for lifting wiring, and the oppositely curved arm is ideal for pulling wires downwardly into the deployed clips. The wire tool has a pair of downwardly projecting legs similar to those of the clip controller. During installation, the legs are fitted within the installation nut slot, and when fully inserted, integral, projecting detents will emerge from the nut bottom and allow the legs to pop apart. The wire tool will thus be resiliently captivated within the nut. Afterwards, when it is desired to change tools, the leg feet need merely be pinched slightly together to compress the detents, and free the tool for removal.

The preferred gutter clip comprises a central baseplate, an integral, upper latch projecting towards the lip of the gutter, an integral, lower foot, and an integral, outwardly angled cradle for holding the wiring. The generally rectangular baseplate functions as a frame, and when the clip is properly deployed, it is oriented vertically. The latch comprises a horizontal arm integrally projecting away from the baseplate. The arm terminates in an integral barb that engages the gutter lip for mounting. The gutter clip foot projects away from the baseplate and contacts the gutter to bias and tension the arrangement, enabling the clip to resiliently, snap-fit to the target.

The resilient cradle extends away from the gutter clip baseplate on the opposite side of the arm and foot. The cradle comprises a pair of interconnected, arcuate segments, and it terminates in an outer tab. An open throat between the cradle tab and the baseplate admits the wiring to be installed. Importantly, a semicircular controller region is defined between the larger cradle arcuate segment and the baseplate. This region is adapted to be yieldably penetrated by the clip installer prong to temporarily captivate and manipulate a clip.

The adhesively-backed clip is designed to be pressed against and stuck to available flat surfaces. Each adhesive clip comprises a baseplate that supports an integral, outwardly projecting cradle. The resilient, angled cradle comprises an arcuate segment terminating in an integral, outer tab. As with the gutter clip, a semicircular controller region is defined between the cradle and the baseplate for engagement by the clip controller prong during installation. As before, a throat is defined between the cradle tab and the baseplate surface for supporting wiring extending between the clips. Unlike the gutter clips, each adhesive clip has an adhesive layer on the underside of the baseplate that is normally covered by a peel-away sheet. Prior to installing an adhesive clip captivated by the clip controller, the sheet is peeled away, and the clip is press-fitted to the desired target with the aid of the pole.

In the best mode, all clips have numerous, integral, transverse cylindrical bosses traversing their width. These bosses facilitate ejection from the high-speed mold. Additionally, the spaced apart bosses reinforce the clips, adding substantial strength and durability to prevent breakage.

Thus, a basic object of our invention is to provide a streamlined technique for installing and/or uninstalling decorative strings of lights upon or within various structures, enclosures, buildings, residences, or the like.

Another fundamental object is to provide an installation method and apparatus for stringing Christmas lights and decorations.

A similar object is to provide resilient plastic clips that can be easily deployed upon gutters or other support structure for receiving and reliably holding decorative strings of lights.

Yet another object is to provide a simple, multi-piece system of the character described that may be used by a single individual for installing decorative light strings, while stably positioning himself or herself as close as possible to the ground, the floor, or other horizontal supporting surface.

Another related object is to provide resilient wire-holding clips that can be quickly snap-fitted to conventional, residential gutters.

Another object of our invention is to provide a pole-like tool that enables a single person to install and/or uninstall not only the resilient holding clips, but also the wiring that is supported by the clips.

Another object is to provide a safe method for mounting decorative light strings, and for pre-attaching the clips used to support the wires, to available roof structures such as rain gutters, without ladders, stools, lifting equipment, scaffolding or similar elevating structure.

Yet another simple object of our invention is to provide a resilient clip that snap-fits to conventional gutters, and which is capable of remote control from a safe position upon the ground.

A related object is to provide an alternative clip that adhesively sticks to available flat surfaces, which are present on walls, windows, eaves, conventional gutters, and the like.

A further object is to provide a manipulating tool of the character described that can be employed with common household poles bearing common threads, similar to common ACME threads.

Another important object is to avoid special tools or equipment utilizing compound parts or heavy metal components.

Yet another important object is to provide a simple method enabling the installation of Christmas lights either outside upon a building, or inside.

A still further object of our invention is to provide a clip of the character described that is strong, lightweight, and dependable, and which, when installed, provides an aesthetically pleasing appearance.

A still further object is to provide a decorating system of the character described that is equally suited for either outdoors or inside light displays.

A related object is to provide a highly adaptable and dexterous wiring installation system adapted to readily decorate a variety of structures other than buildings, including parked vehicles, signs, and a variety of natural or man-made objects.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
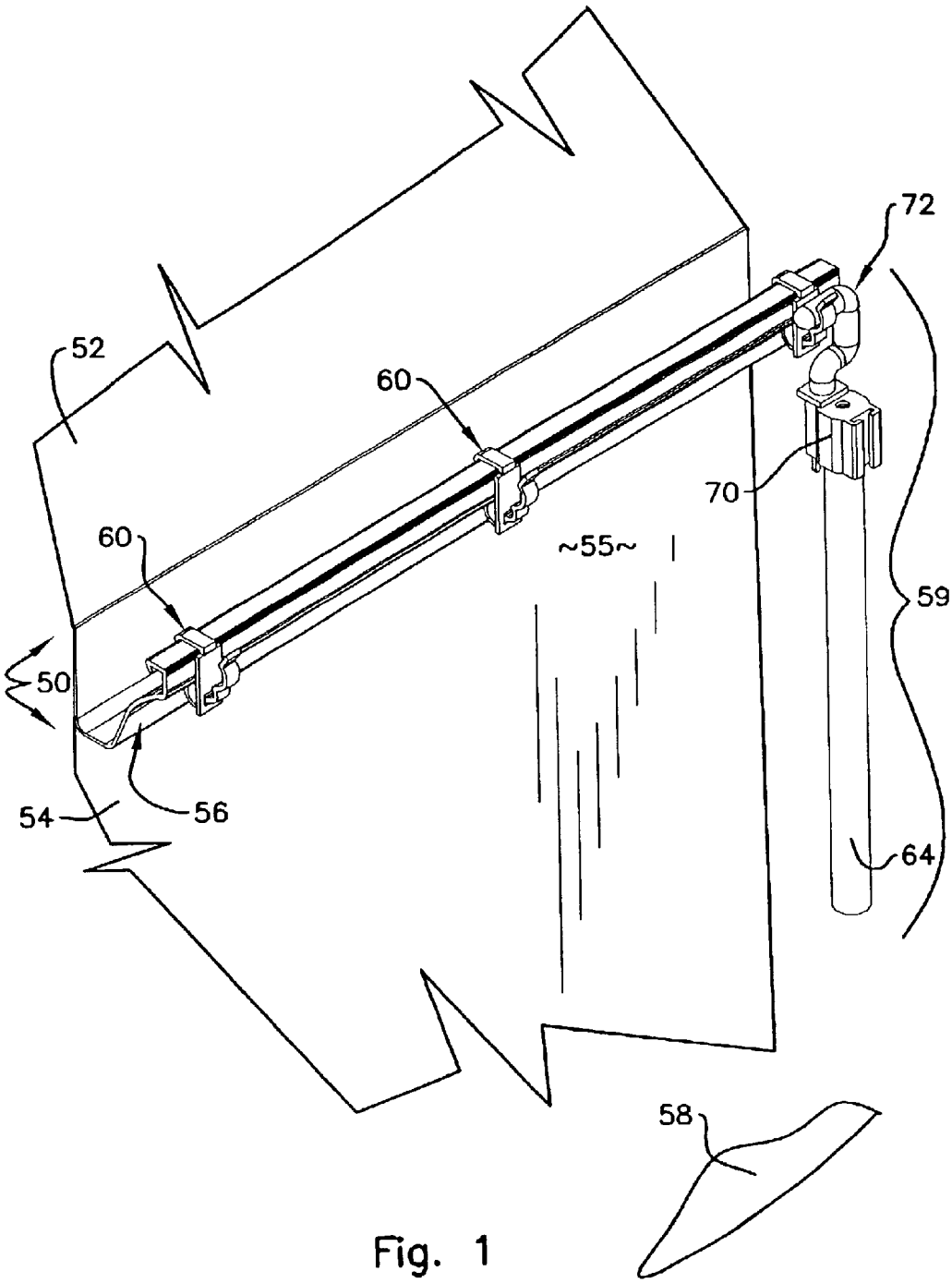
FIG. 1 is a fragmentary, diagrammatic and pictorial view showing portions of a conventional roof line and gutter, showing an installation pole and tool, and a plurality of spaced-apart mounting clips.

Referring now to the appended drawings, a building 50, upon which decorative lights are to be installed, has been schematically illustrated in FIG. 1. Building 50 may comprise a single-family or multi-family residence, a commercial building, temporary shed or the like. Building 50 comprises a conventional roof 52 structurally separated from an outer, vertically oriented wall 54. An elongated gutter 56 is disposed above wall 54 proximate the lowermost edges of roof 52 for collecting and redirecting rain water in the usual fashion. Our system, generally designated by the reference numeral 59, is partially illustrated in FIG. 1. As explained in detail hereinafter, one incarnation of our system 59 enables an applicator to install strings of Christmas lights upon gutter 56, while stably positioned as close as possible to either the ground 58, an interior floor, or some equivalent generally, horizontal, supporting surface. As explained in detail later, alternative configurations of the concept enable decorative wires to be installed upon and supported by flat surfaces, such as the outer surface of wall 54 (FIG. 1).

Figure 2:
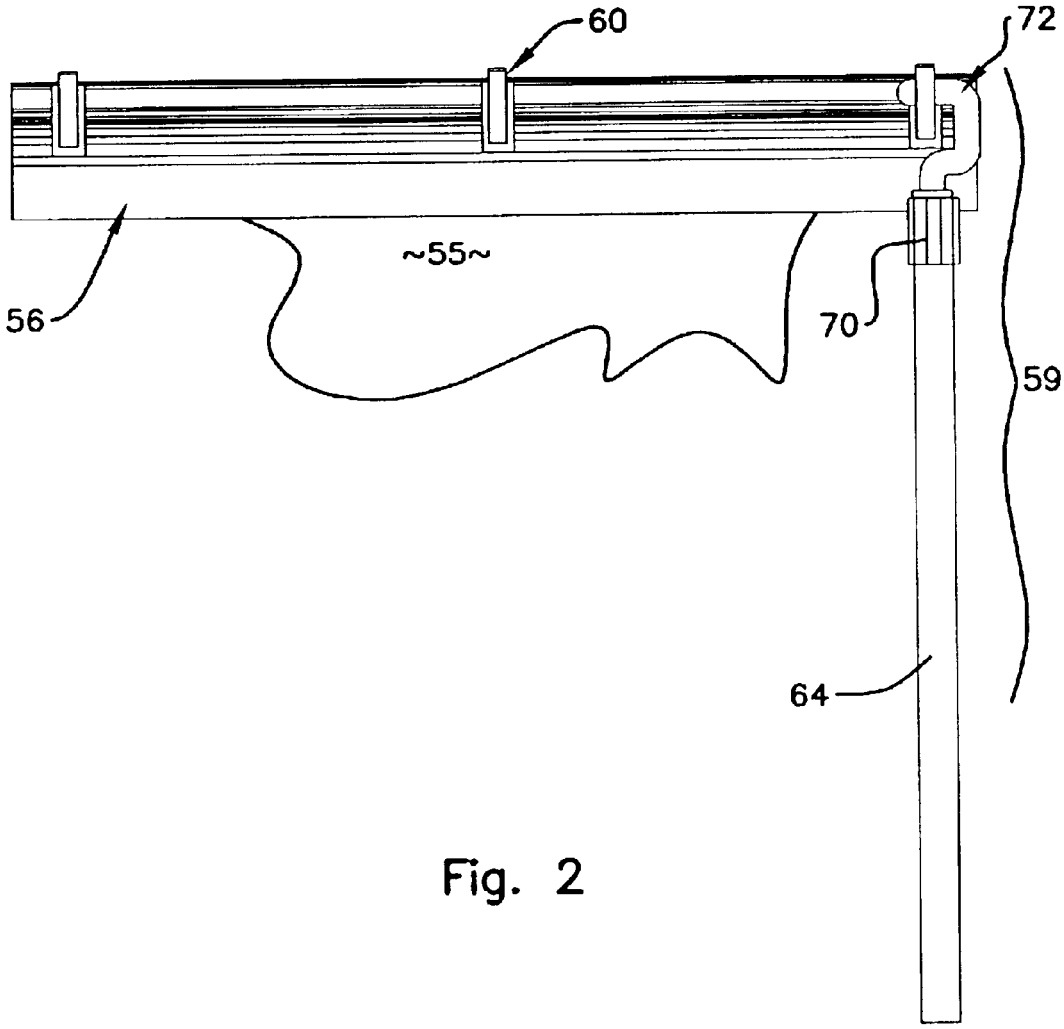
FIG. 2 is a fragmentary, plan view of the gutter and installation apparatus of FIG. 1.
Figure 29:
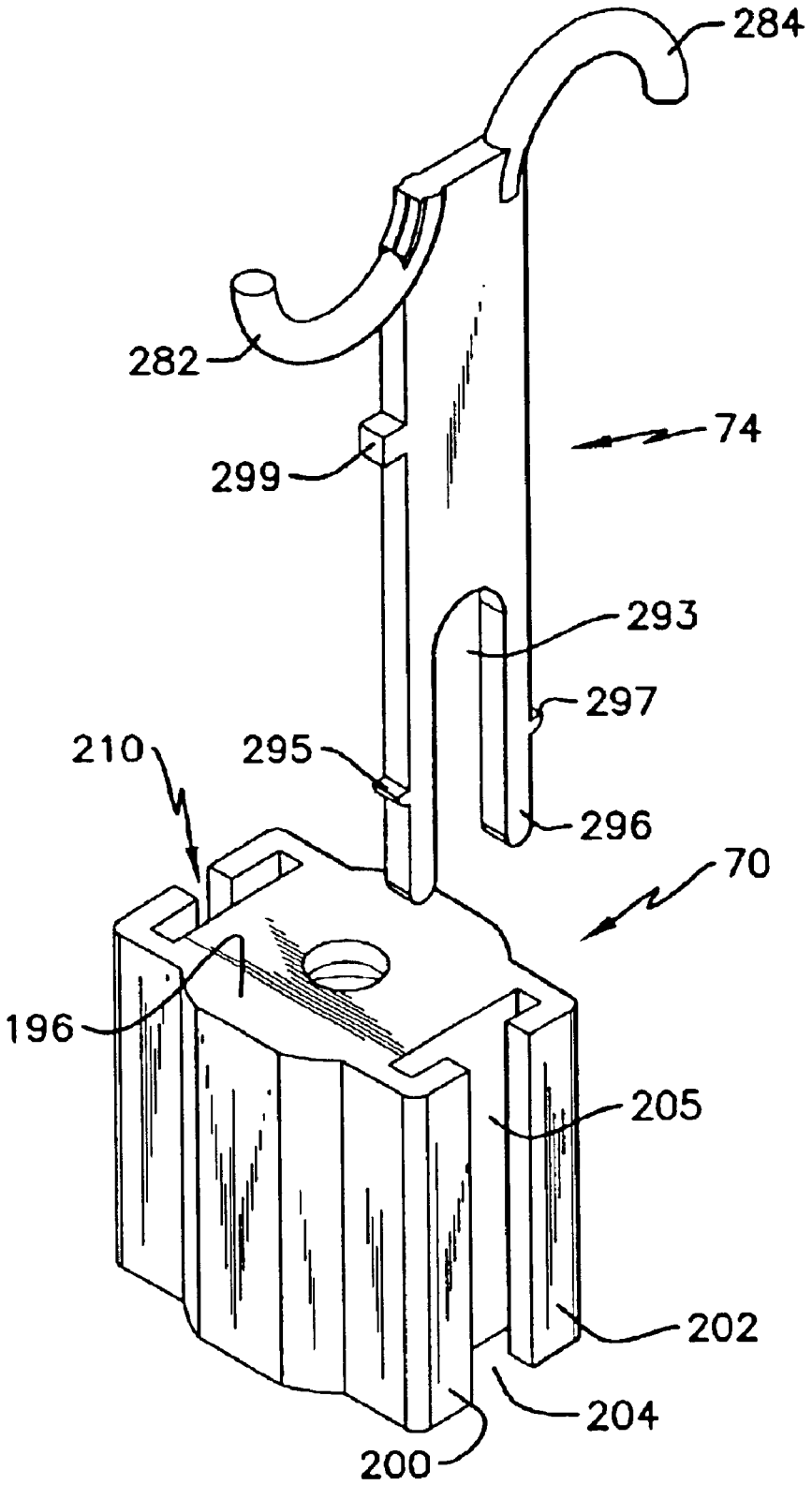
FIG. 29 is an exploded, isometric view showing the wire tool positioned to be inserted into the installation receptacle.

Referring jointly to FIGS. 1 and 2, system 59 has deployed a plurality of resilient, gutter clips 60, at spaced-apart intervals along the length of the gutter 56. As described in adequate detail hereinafter, system 59 broadly comprises a conventional, elongated pole 64 that remotely controls not only the installation of the gutter clips 60 and/or adhesive clips 66 (i.e., FIGS. 21–24) to be described later, but subsequent deployment of the desired light strings that are suspended from the clips. Moreover, gutter clips 60 can be removed with the same equipment where necessary. Pole 64 is preferably extensible. However, common household poles, like those used with mops for example, can be used, as long as one end terminates with an appropriate thread 63 (i.e., FIG. 35) that is similar to an ACME thread. A resilient, barrel-like installation nut 70 is threadably coupled to pole 64 to aid the installation process. Tool accessories described later herein may be releasably fitted to nut 70 for ultimately controlling either clips 60 or 66. For example, FIGS. 1 and 2 illustrate the preferred clip-controller tool that is releasably fitted to nut 70 to manipulate the desired gutter clips 60. Alternatively, a wire tool 74 (i.e., FIGS. 27, 29) adapted to be temporality fitted to nut 70 manipulates wire strands, and guides them towards engagement with the gutter clips 60 or adhesive clips 66.

Figure 3:
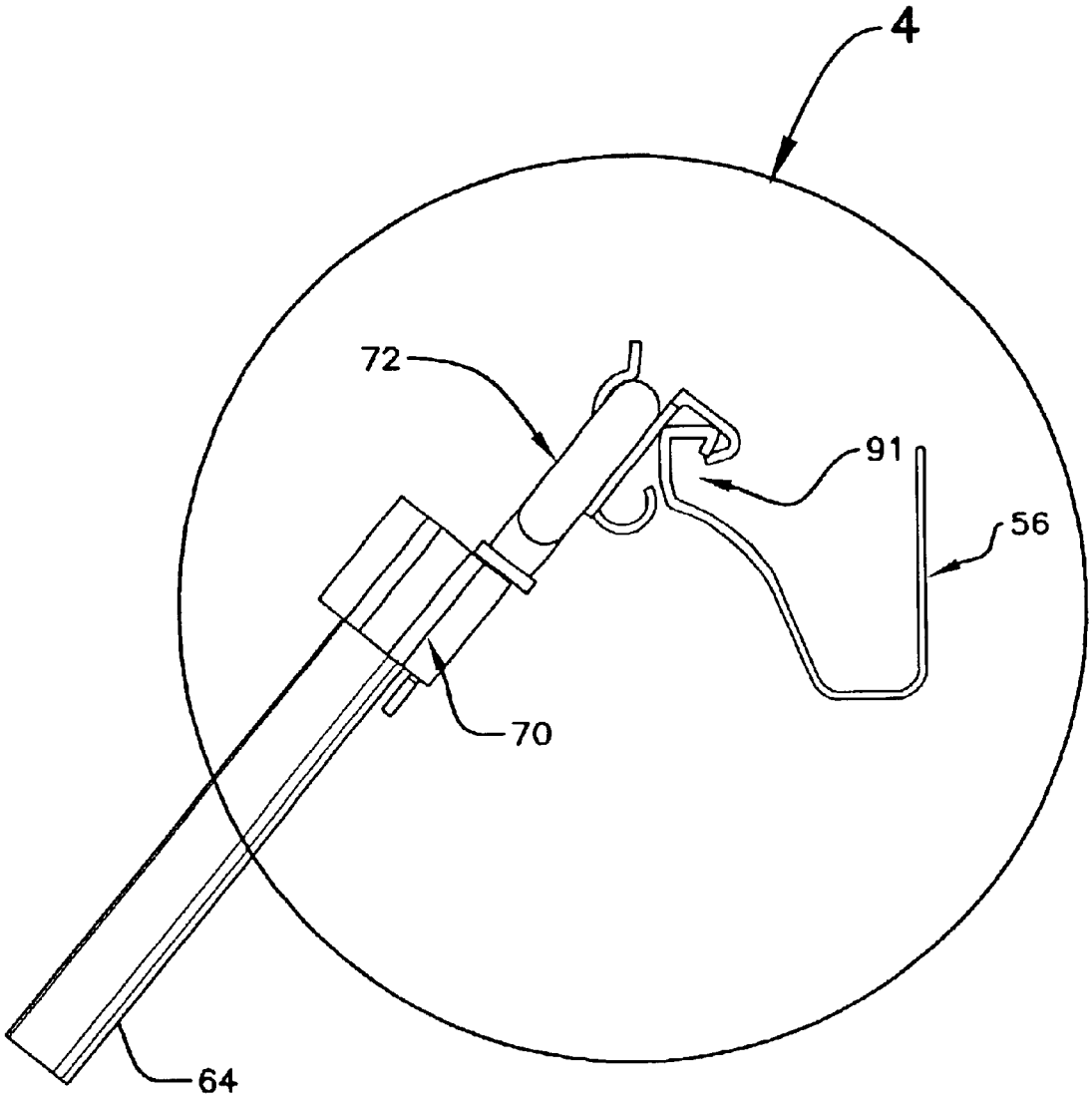
FIG. 3 is an enlarged, fragmentary, side view showing the gutter and installation apparatus.
Figure 4:
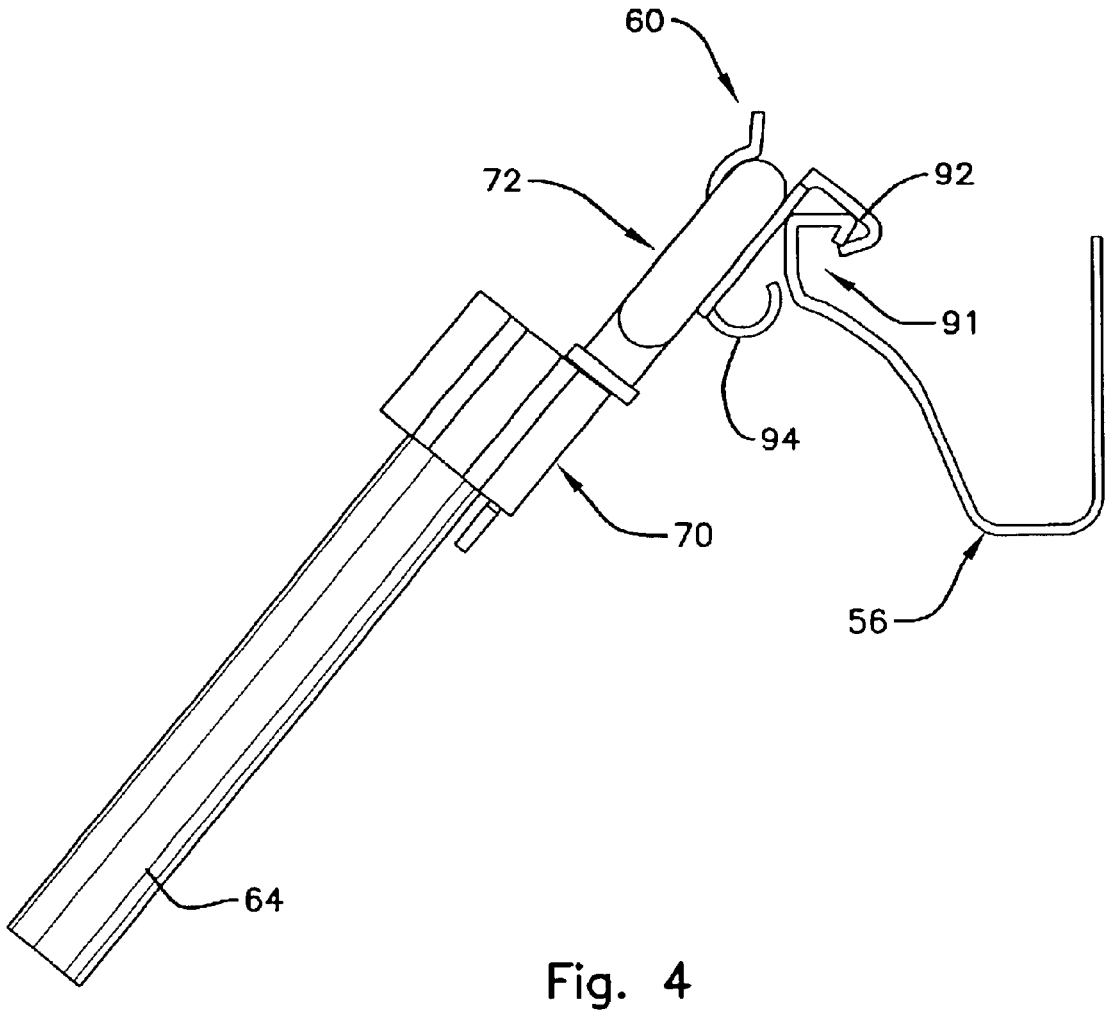
FIG. 4 is an enlarged, plan view derived from circled region 4 in FIG. 3, showing a gutter clip disposed in an intermediate position as it is installed upon the gutter.
Figure 5:
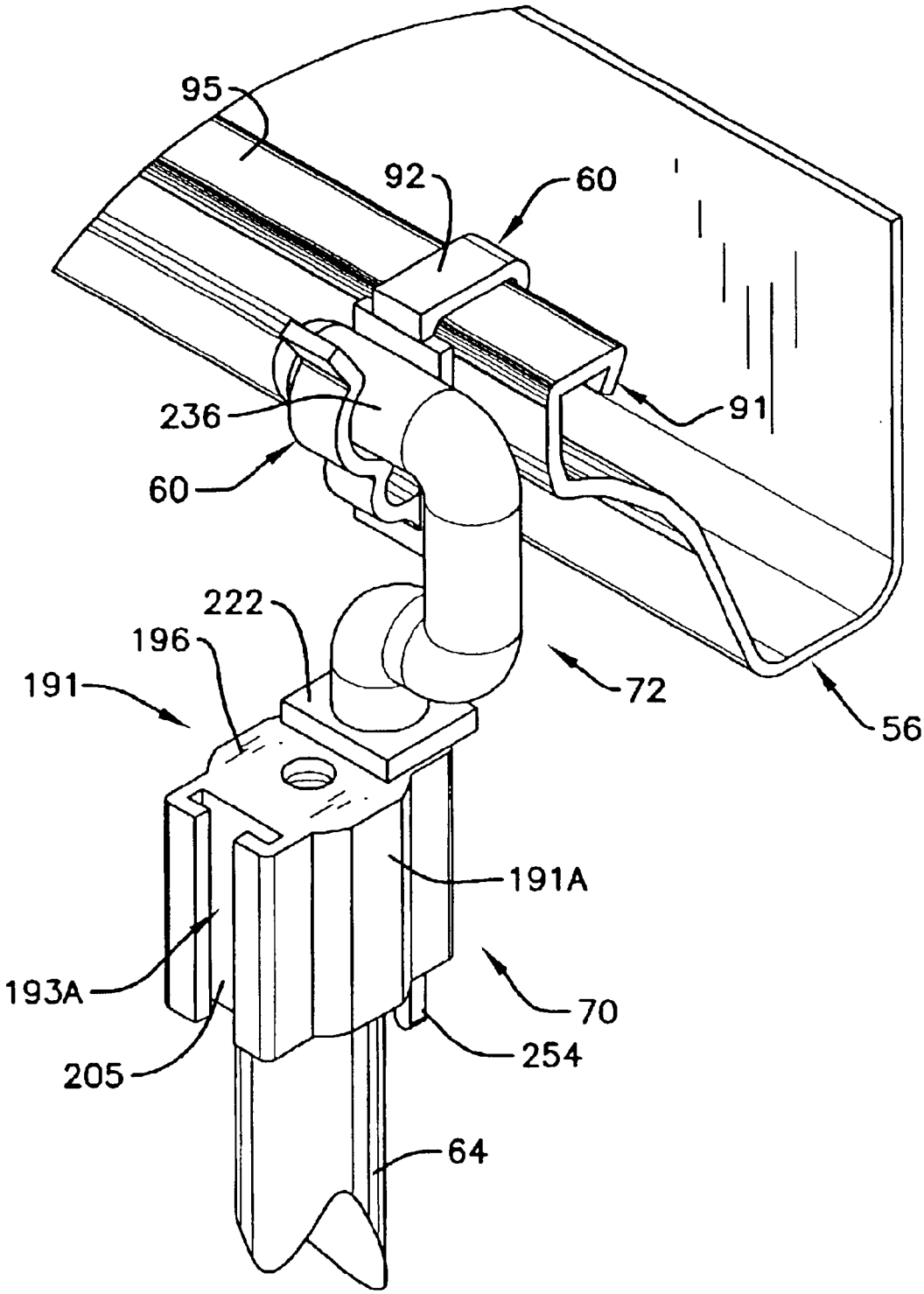
FIG. 5 is an enlarged, fragmentary isometric view showing the installation apparatus and a clip disposed in an installed position upon a gutter.
Figure 19:
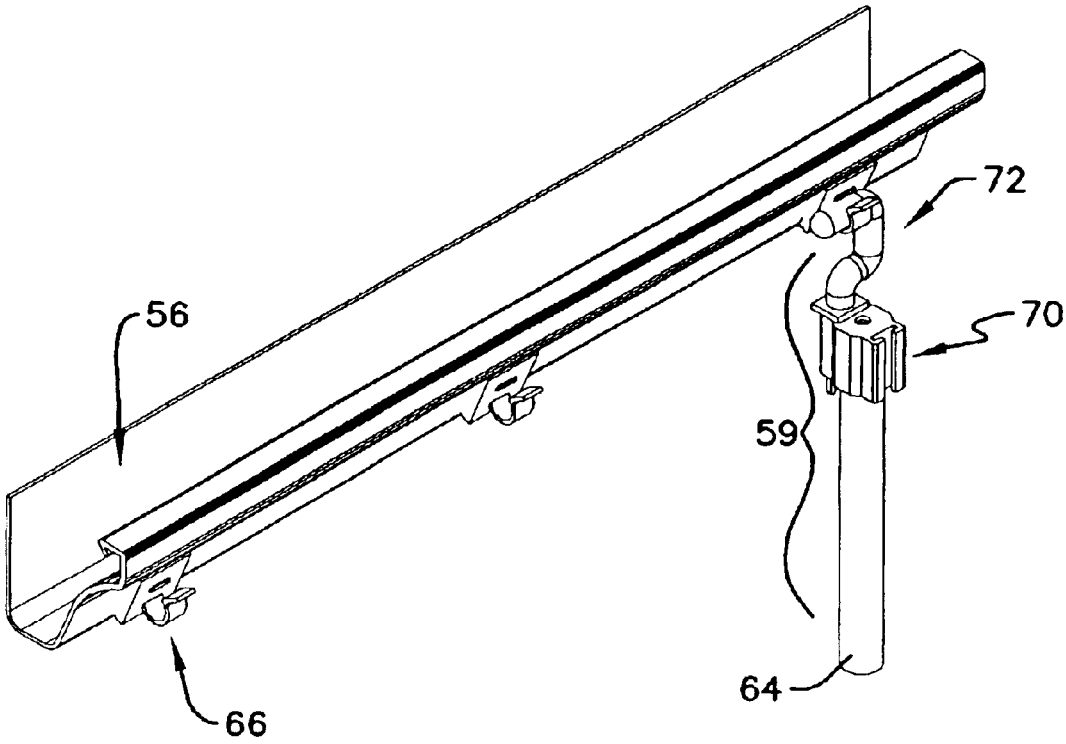
FIG. 19 is a fragmentary, isometric and diagrammatic view similar to FIG. 1, but showing the clip controller mounting an adhesive clip upon a gutter.
Figure 20:
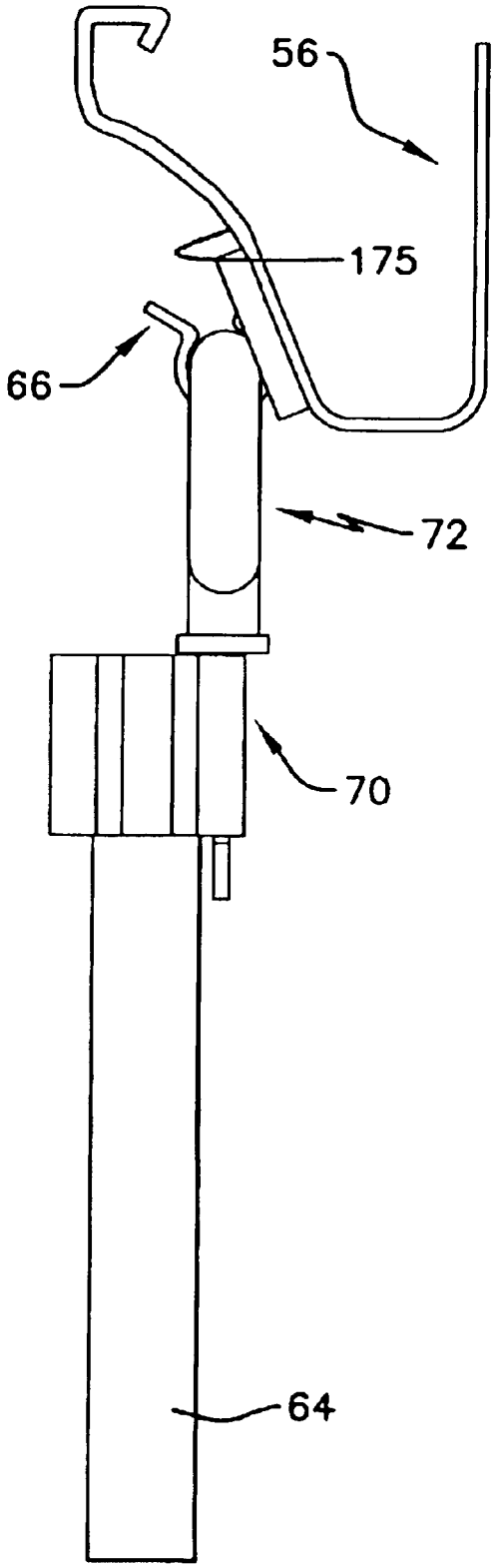
FIG. 20 is an enlarged, fragmentary side elevational view of the apparatus of FIG. 19.

As seen in FIGS. 3–5, pole 64 supports nut 70 and the clip controller 72, which temporarily hold a clip 60 to be installed upon gutter 56. Alternatively, a plurality of adhesive clips 66 (FIG. 21) may be installed by controller 72 upon a variety of available flat surfaces, as illustrated generally in FIGS. 19, 20. After the predetermined quantities of clips 60 and/or are thusly installed, wire tool 74 (i.e., FIGS. 28–30) may be substituted for clip controller 72, and the light strands 80 (FIG. 31) may be manipulated into engagement with the chosen clips. Wire tool 74 allows the user to either install Christmas lights or remove them from the various clips that are preinstalled in an orderly, elevated arrangement upon the building or other item to be decorated.

The preferred gutter clip 60 (FIGS. 6–10) can assume a variety of specific configurations, and it can be constructed from a variety of materials. In the best mode known to us at this time, gutter clips 60 are injection molded from polyethylene. To fit as wide a variety of gutters as possible, clips 60 are approximately 3.0 cm. high and 3.0 cm. wide in the best known mode. Of course, they may be smaller or larger depending upon application requirements and a variety of related design considerations known to those skilled in the art. Each gutter clip 60 (i.e., FIG. 6) comprises a central baseplate 90, an integral, upper latch 92, an integral, lower foot 94, and an integral, outwardly angled cradle 96. As best seen in FIG. 4, upon installation, latch 92 and foot 94 face the gutter 56.

Figure 6:
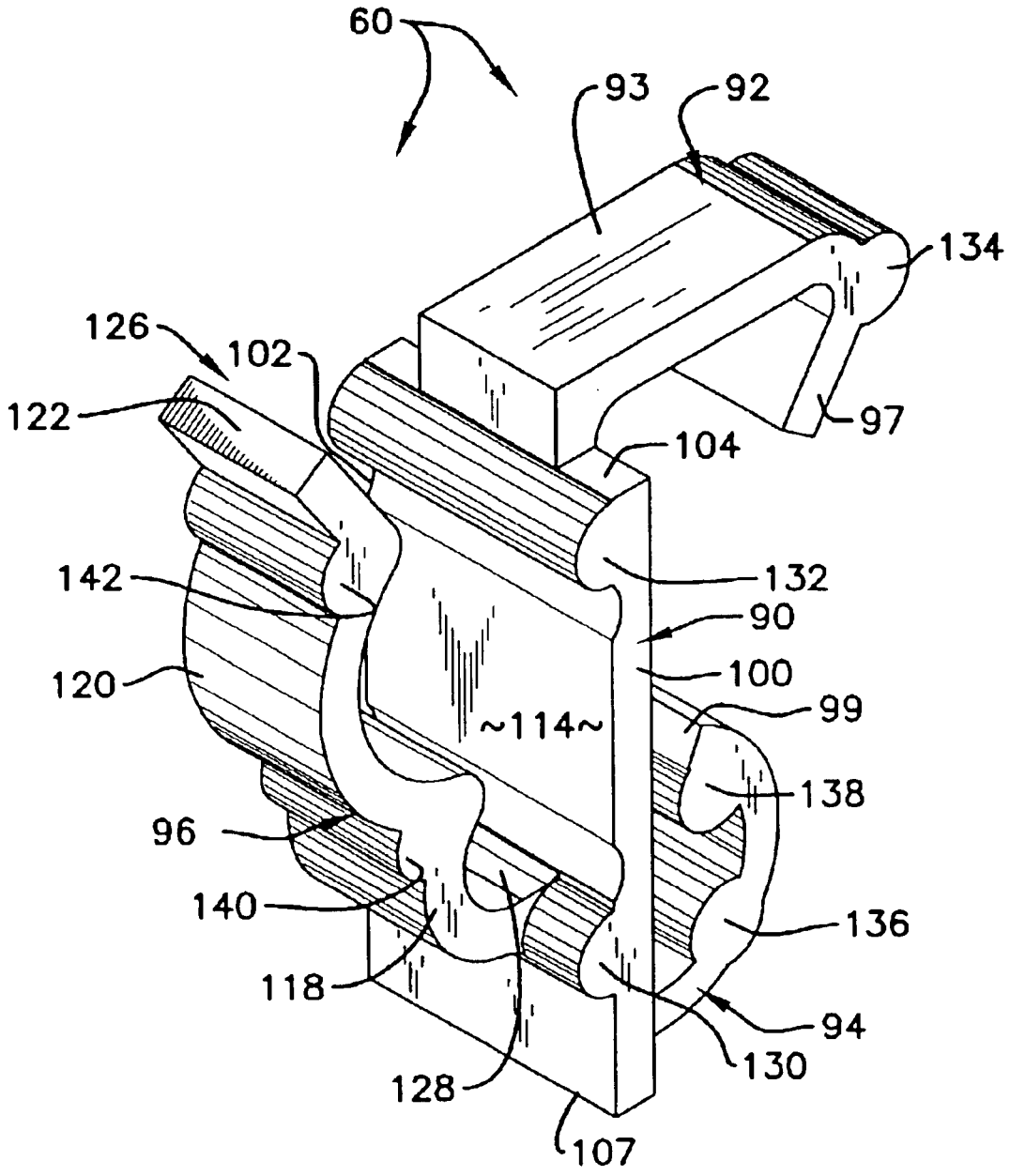
FIG. 6 is an enlarged, frontal isometric view of the preferred gutter clip.
Figure 9:
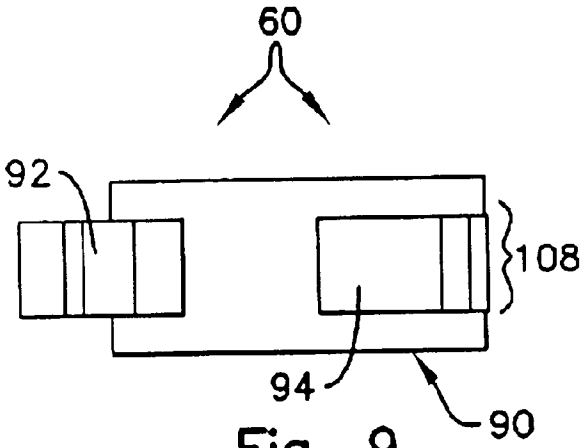
FIG. 9 is a right side elevational view of the gutter clip.
Figure 7:
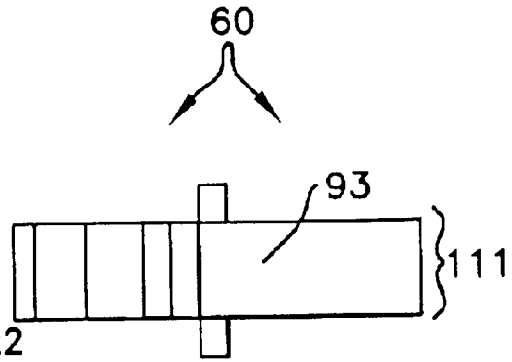
FIG. 7 is a top plan view of the gutter clip of FIG. 6.
Figure 8:
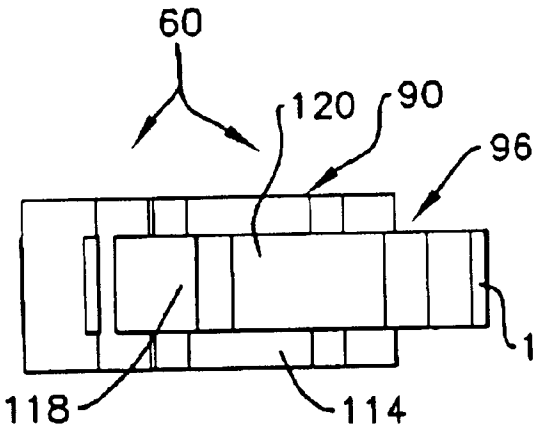
FIG. 8 is a left side elevational view of the gutter clip.

As seen in FIGS. 6, 8, and 9, the gutter clip baseplate 90 is generally rectangular and planar. When gutter clip 60 is properly deployed, baseplate 90 is oriented substantially vertically with respect to the ground. The width of the baseplate between edges 100, 102 (FIG. 6) is approximately 12 mm. in the best mode. The length or height of the baseplate as measured between upper shoulder 104 and lower edge 107 (FIG. 6) is approximately 28 mm. The width of cradle 96, foot 94, and latch 92, is approximately 5 mm. in the best mode. Thus, in the best mode known at this time, the width dimension 108 (FIG. 9) is approximately twice that of width dimension 111 (FIG. 7).

Latch 92 comprises a horizontal arm 93 integrally projecting away from the upper shoulder 104 of baseplate 90 which surmounts the upper, outer gutter edge 95 (FIGS. 5, 6). Arm 93 outwardly terminates in an integral, downwardly curved barb 97 that operationally engages the inwardly-turned barb of gutter lip 91 (FIGS. 4, 5). The lower foot 94 of the gutter clip integrally projects away from the bottom of the clip baseplate 90. When a gutter clip is properly installed, foot 94 physically contacts the exposed, external surface of the gutter, enabling the clip to resiliently snap-fit to the gutter, in combination with insertional deflections of arm 93 and barb 97. Foot 94 (FIG. 10) is semi-circular in cross section, ending in an inwardly projecting, open, terminal end 99 (FIGS. 6, 10), that faces the baseplate 90. The gap (FIG. 10) between foot end 99 and the baseplate 90 permits slight bending of the foot as the clip is yieldably deformed and compressed during installation. A small, narrow reinforcement runner 110 (FIG. 10) extends at one side of the clip integrally between the foot end 99 and the baseplate 90 to add further resilience.

Figure 10:
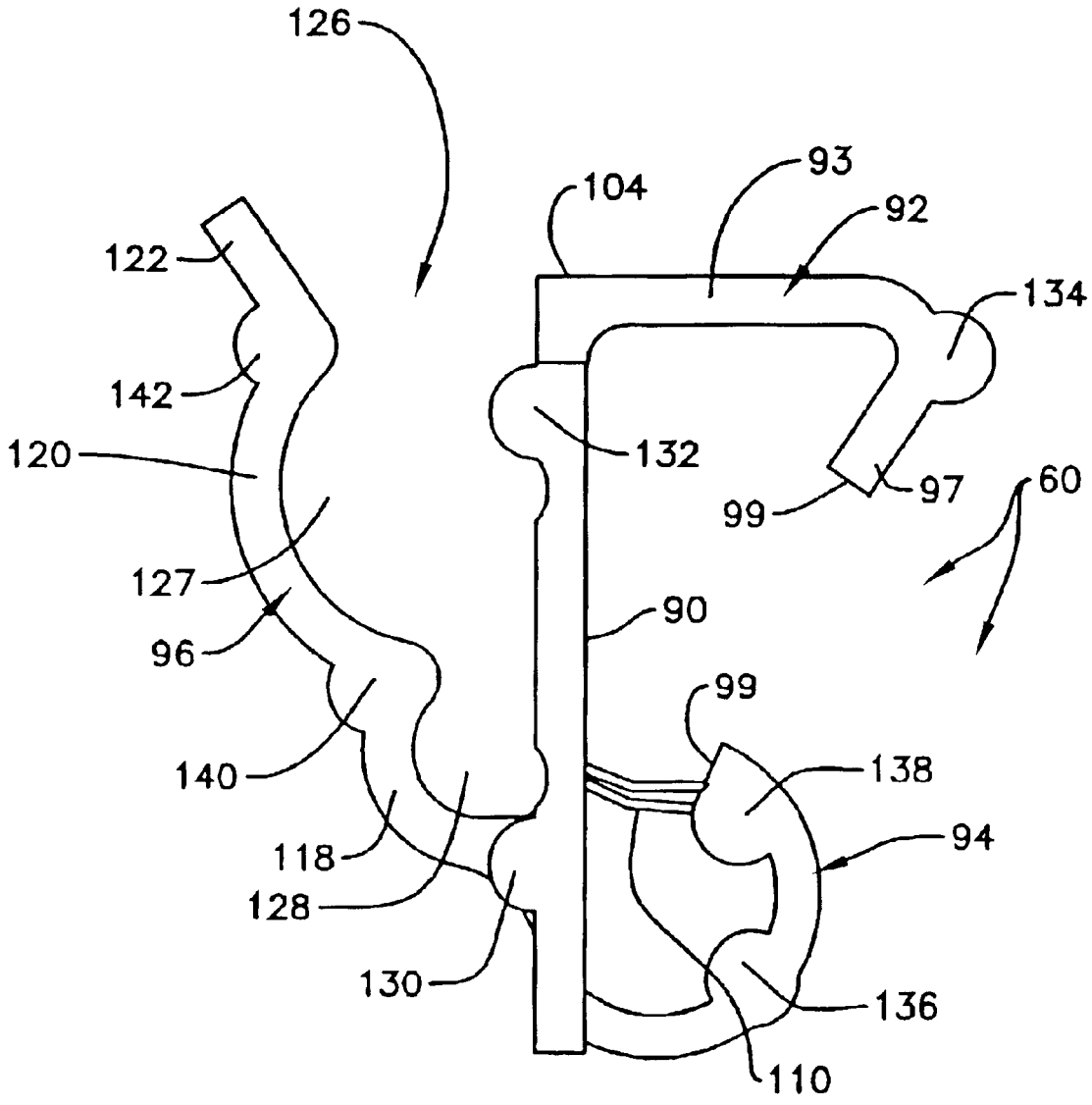
FIG. 10 is an end elevational view of the gutter clip.

The integral, resilient cradle 96 extends angularly upwardly away from the lower external surface 114 (FIGS. 6, 8) of the baseplate 90. In the best mode, the resilient cradle 96 comprises a lower, arcuate segment 118 (FIG. 10) extending from the bottom of the baseplate 90, a larger, intermediate arcuate segment 120, and an angled tab 122. The open throat 126 (FIGS. 6, 10) defined between cradle tab 122 and baseplate 90 admits wires or other structures to be held by the clips after installation. After the clips are placed properly, the Christmas light wiring, for example, can be lifted into a position proximate throat 126, and upon release, the wiring will drop into the lowermost, hollow support region 128 (FIG. 10) between cradle lower segment 118 and baseplate 90. During installation, as explained in more detail later, the clip controller 72 (i.e., FIG. 5) engages the larger control region 127 (i.e., FIG. 10) defined between the large cradle segment 120 and the baseplate 90 of gutter clip 60 above region 128 (FIGS. 6, 10). Control region 127 is dimensioned to properly fit with and support conventional rope lights, which essentially comprise plastic tubes with strings of lights or LED's within them.

In the best mode, various portions of the gutter clip 60 are reinforced with cylindrical bosses that are integrally molded into the clip structure. Each of these reinforcement bosses traverses the width of the pertinent clip structure, and terminates at each outer extremity in a substantially circular end. During the molding process, follower pins enter the mold cavities to eject the clips by contacting the ends of these reinforced bosses. Thus in the best mode, the baseplate 90 has a boss 130 (FIGS. 6, 10) traversing its width at a point diametrically between cradle segment 118 and foot 94, and a second, upper, boss 132 at its top reinforcing shoulder 104. Latch 92 has a transverse boss 134 (FIGS. 6, 10) at the junction between arm 93 and barb 97. Foot 94 preferably has a lower boss 136 at its midpoint, approximately between baseplate boss 130 and foot end 99 (FIG. 6). Another boss 138 reinforces foot end 99. Similarly, cradle preferably has an integral, transverse boss 140 defined between cradle segments 118 and 120, and another boss 142 defined between cradle segment 120 and tab 122.

An alternative, adhesively-backed clip 66 (FIGS. 21–26) is designed to be press fitted and stuck to available flat surfaces. All system installation kits will be shipped with both gutter clips and adhesive backed clips 66. Some gutters vary in shape so much that gutter clips will not fit properly. However, many gutters have exposed, flat surface portions to which adhesive clips 66 readily stick. Furthermore, adhesive clips 66 easily mount to exposed wall surfaces 55 (FIG. 1), siding panels, windows, and/or other flat items and structures proximate an area to be decorated.

Figure 21:
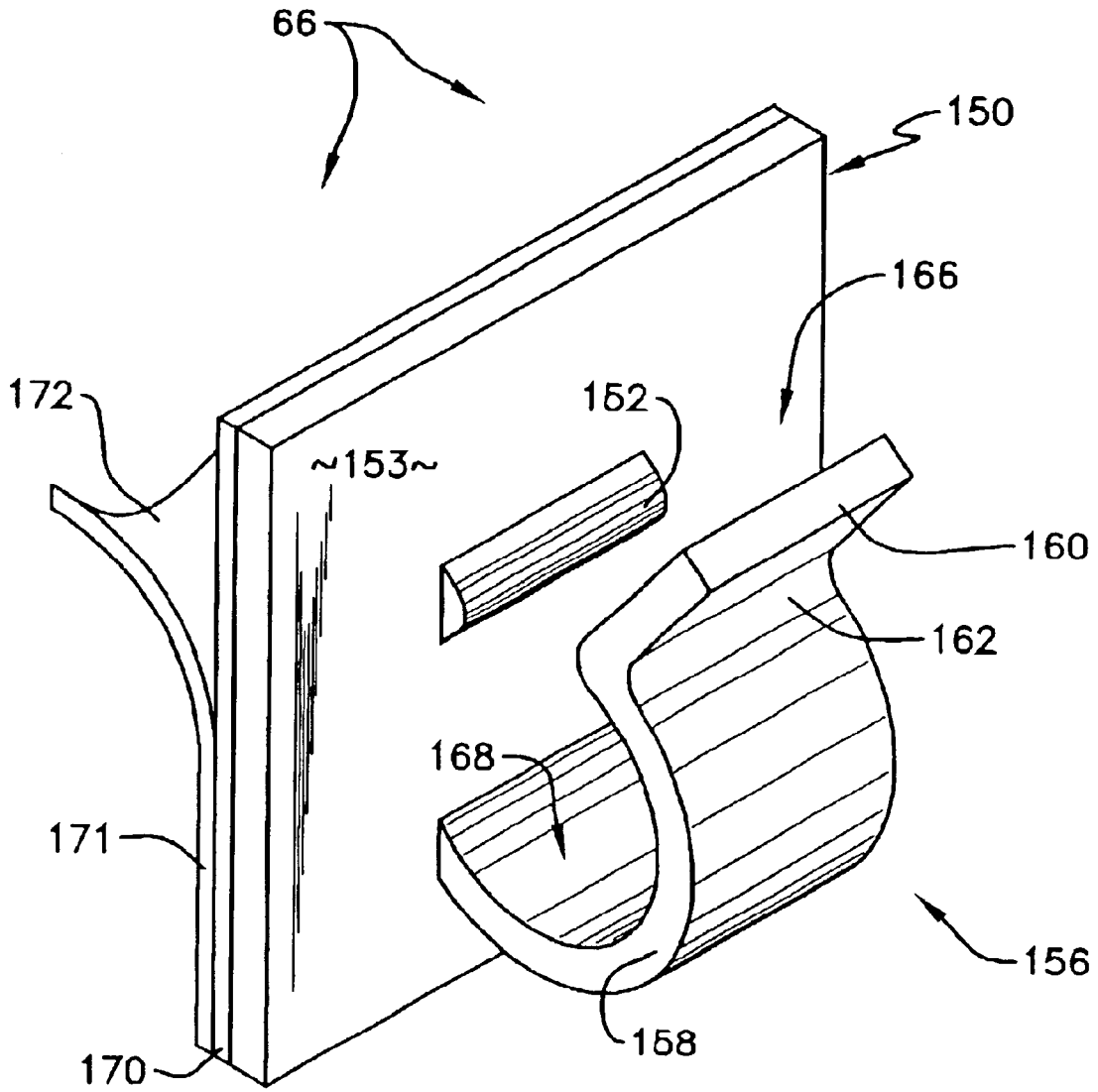
FIG. 21 is an enlarged, frontal isometric view of the preferred adhesive clip, with a portion of the rear adhesive backing partially displaced.
Figure 24:
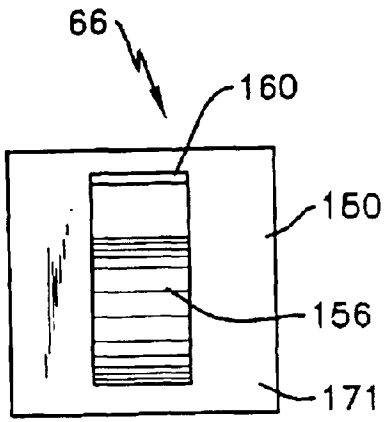
FIG. 24 is a front plan view of the adhesive clip.
Figure 25:
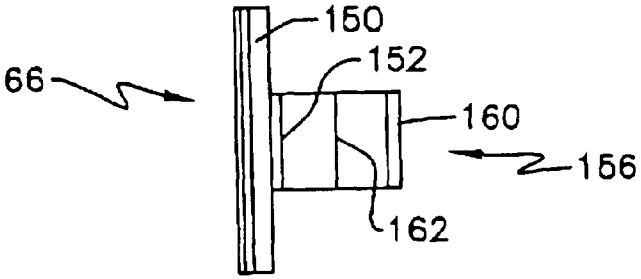
FIG. 25 is a top plan view of the adhesive clip.
Figure 22:
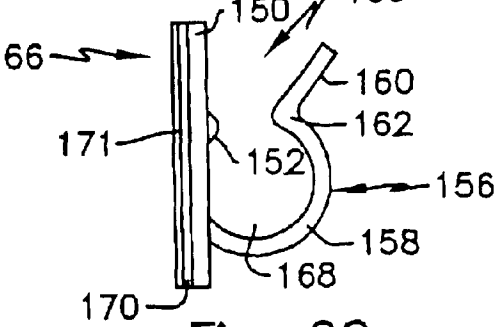
FIG. 22 is a side elevational view of the adhesive clip, the opposite side comprising a mirror image thereof.
Figure 26:
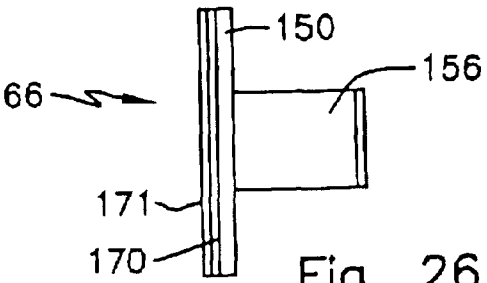
FIG. 26 is a bottom plan view of the adhesive clip.
Figure 23:
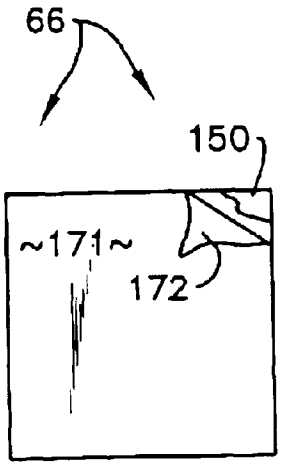
FIG. 23 is a rear plan view of the adhesive clip, with portions thereof broken away, moved, or shown in section for clarity.

Adhesive clip 66 (FIGS. 21–26), preferably molded from polyethylene, comprises a flat, preferably, square baseplate 150 that is integral with an elongated, offset boss 152 and an angularly, outwardly extending cradle 156. Boss 152 has a semicircular cross section (FIG. 22) and is offset from the front surface 153 (FIG. 21) of the baseplate. Cradle 156 comprises an arcuate segment 158 and an integral, projecting tab 160. Segment 158 originates from baseplate surface 153 from a point substantially beneath boss 152, and curves towards a juncture 162 (FIGS. 21, 22) from which tab 160 originates. A throat 166 (FIG. 21, 22) is defined between tab 160 and baseplate surface 153. Wiring to be supported by adhesive clip is guided or dropped through throat 166 into hollow, control region 168 defined between cradle 156 and surface 153 (FIG. 21). The control region 168 also functions as a support region, because wiring to be supported by the cradle is disposed within this region. Furthermore it "fits" rope lights, as discussed in conjunction with clip 60.

Importantly, adhesive clip 66 comprises an adhesive layer 170 (FIGS. 22, 23) affixed to the rear of baseplate 150. Prior to installation, the adhesive layer is normally covered by a removable, peel-away backing 171 preferably made of plastic. By simply grabbing a corner 172 (FIGS. 21, 23) of the temporary backing 171, it is peeled-away and removed from the clip baseplate to expose the adhesive layer 170, and thereafter the clip may be attached where desired. As is the case with gutter clips 60 described previously, the adhesive clips 66 (FIG. 20) are installed with the clip controller 72, which temporarily penetrates control region 168 (FIG. 21) to facilitate clip manipulation As seen in FIG. 20, the installation pole 64 is manipulated by the user from a safe, stable position as close as possible to the ground. Clip controller 72, which is in turn held by installation nut 70, holds the clip as it is pressed towards an available flat spot. For example, a relatively flat spot 175 on the exterior of gutter (FIG. 20) has been selected for application of an adhesive clip 66.

Both clips 60, 66 are installed with clip controller 72 (i.e., FIGS. 5, 11–14), which in turn is controlled by and releasably mounted to the barrel-like installation nut 70 mentioned previously. Nut 70 is described in detail in co-pending application Ser. No. 09/993,983, filed Nov. 16, 2001, entitled "Suspension Ceiling Clips and Installation Method," which is owned by the same assignee as in this case. For purposes of disclosure and enablement, the latter application is hereby incorporated by reference.

Figure 34:
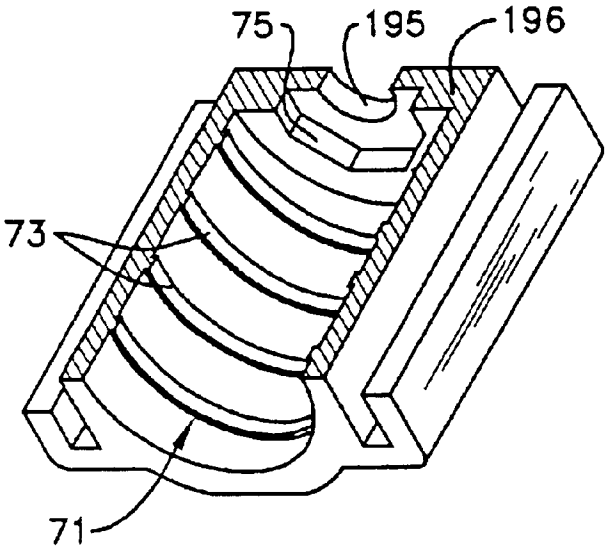
FIG. 34 is an enlarged, fragmentary, bottom isometric view of the preferred nut.
Figure 33:
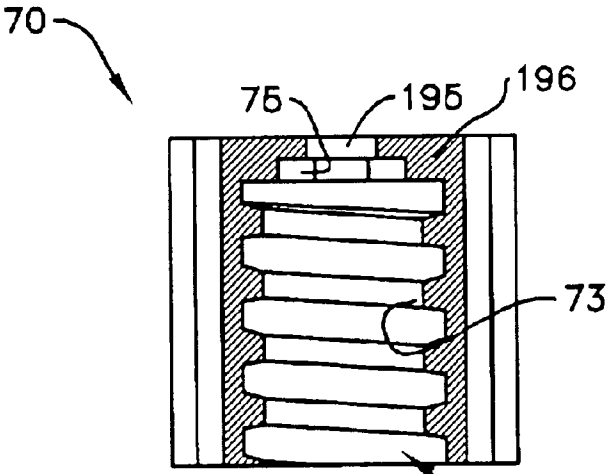
FIG. 33 is a longitudinal sectional view of the nut taken generally along line 33—33 of FIG. 32.
Figure 32:
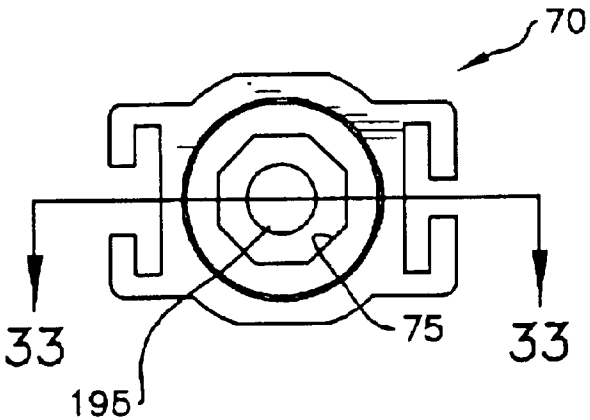
FIG. 32 is a bottom plan view of the preferred installation nut.
Figure 35:
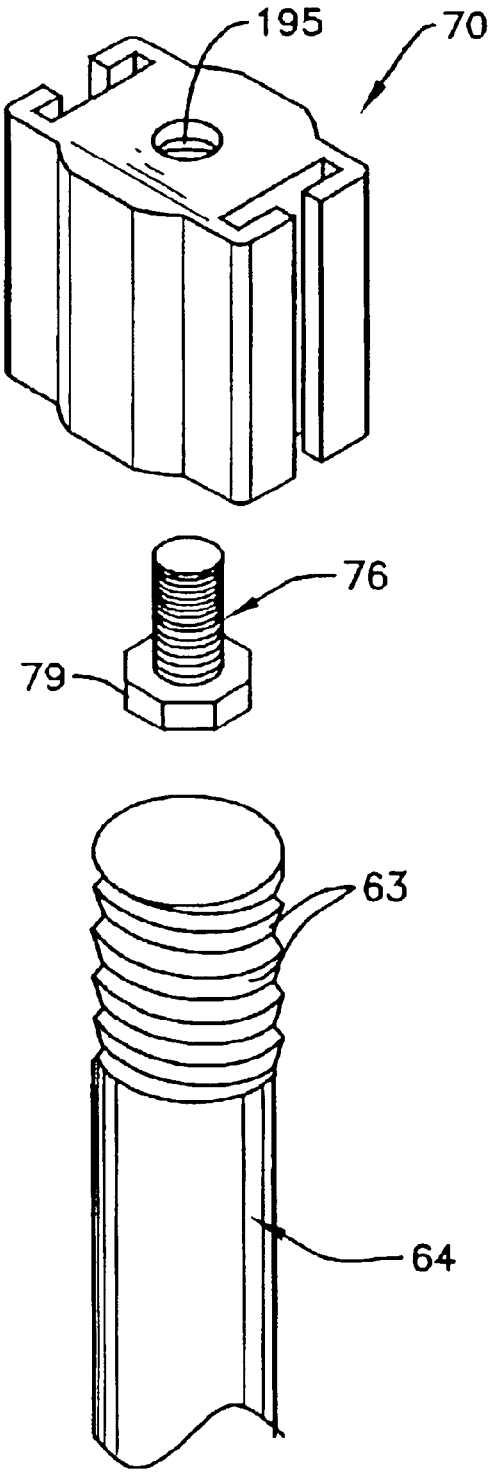
FIG. 35 is a partially exploded and fragmentary isometric view showing how an optional bolt may be captivated within the installation nut.
Figure 36:
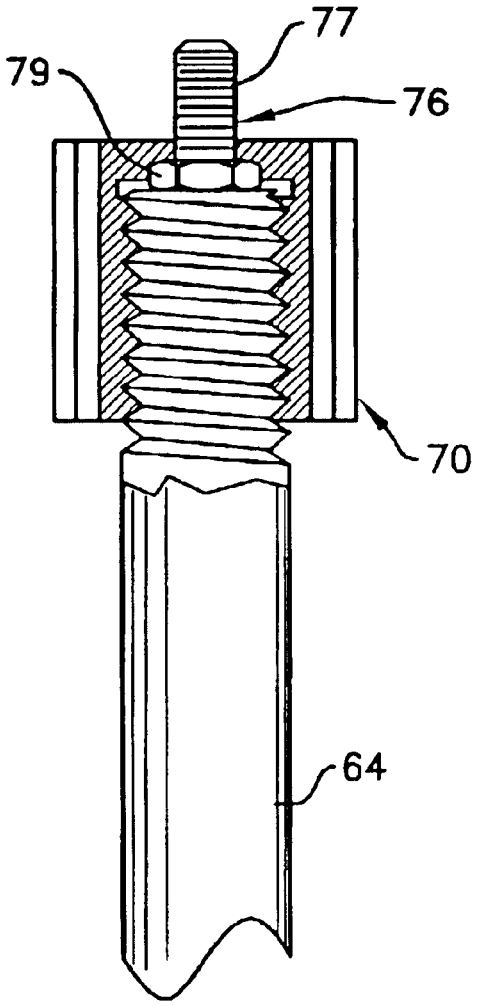
FIG. 36 is an partially fragmentary, sectional view of the apparatus of FIG. 35.

A preferred, two-piece, telescopingly extensible pole 64 (FIGS. 1, 5) is conventional. Alternatively, a three or four-piece pole comprising a plurality of screw-together segments may be employed. It terminates in a common thread, similar to an ACME thread, that is threadably mated to nut 70. A suitable threaded socket (not shown) is defined within the installation nut 70 for mating with pole 64. The receptacle is releasably, threadably engaged by pole 64, for manipulation from the floor or ground. The socket at the underside of nut 70 comprises an internal bore 71 (FIGS. 33, 34) defining a tubular interior that is coaxial with upper orifice 195 (FIG. 12) defined in nut top 196. Preferably, the socket is internally threaded with threads 73, similar to an ACME thread. As best seen in FIGS. 33–34, in the best mode known to us at this time there is a hexagonal recess 75 defined in the underside of nut top 196. Thus when a hex head bolt 76 (FIG. 35), for example, is inserted within the nut, it's head seats within hexagonal recess 75 as seen in FIG. 36, thereby preventing twisting. When pole 64 is mated to the nut's threads 73 (FIG. 33, 34), bolt 76 (FIG. 35) is axially captivated within the nut 70 with its shank 77 (FIG. 36) emanating from orifice 195, and exposed for contact with a modified clip controller or modified wire tool. Pole 64 easily screws into nut (FIG. 1). Other readily available poles provided with threads similar to an ACME thread, such as wooden poles of the type commonly used for household mops, brooms and the like, can be substituted for the two-piece aluminum pole 64 seen in the drawings.

The preferred installation nut 70 (FIGS. 5, 12–14) is injection molded from nylon. Nut 70 is somewhat cylindrical, and its periphery comprises a pair of opposed, faceted sides 191, 191A and a pair of slotted receptacles 193, 193A at the nut edges comprising elongated channels of generally parallelepiped dimensions. Importantly, receptacles 193 and 193A (FIGS. 12, 13) function as docking stations for removably and temporarily receiving and controlling various tools such as the clip controller 72 and the wire installer described in detail hereinafter. These twin receptacles are preferably identical, but they may be dimensioned somewhat differently to adapt to differently sized accessories or tools, as will be appreciated by those with skill in the art. With combined reference directed FIGS. 12–14, receptacle 193 preferably comprises a pair of opposed, generally planar retaining arms 200, 202 that face one another across a central gap 204. Each retaining arm 200, 202 is offset from an inner, generally rectangular edge surface 205. An elongated, transverse captivation slot 210 is defined between the arms 200, 202 and the inner edge surface 205 of the installation nut 70. The captivation slot 210 is generally in the form of a rectangular parallelepiped, and in cross section it is generally T-shaped. The tools to be described are slidably mated to the nut 70 by inserting them within slots 210. Means are provided for positioning them properly, and for temporarily, yieldably locking them into position.

With emphasis directed now to FIGS. 5, and 12–17, the resilient clip controller 72 is shaped generally like a question mark. It is preferably injection molded from nylon. The upper body 220 integrally extends from an intermediate plate 222 that is generally square. An integral, projecting fork 224 extends downwardly from the plate 222. Fork 224 is adapted to be releasably coupled to the installation nut 70, as explained below.

Figure 14:
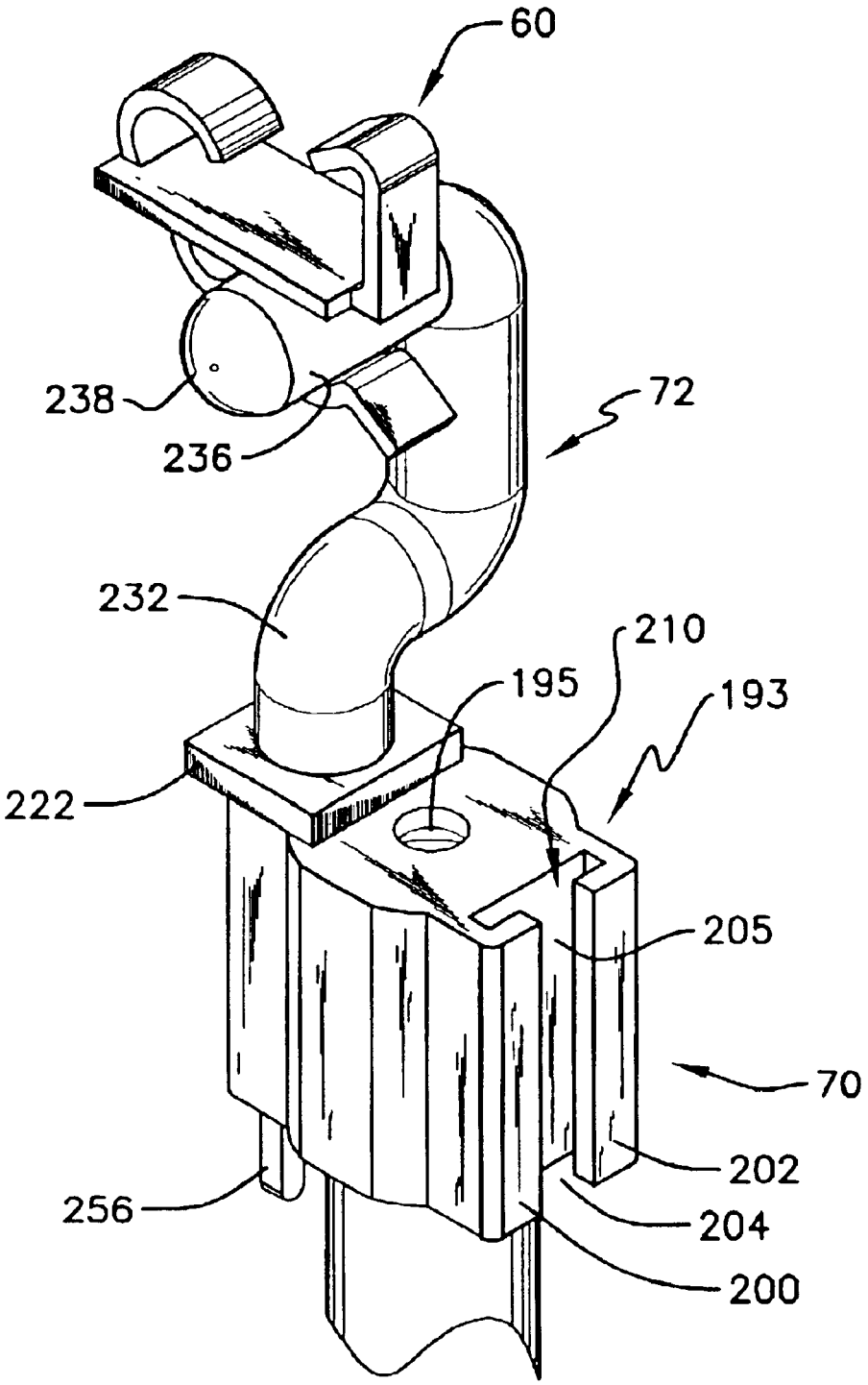
FIG. 14 is an isometric view similar to FIG. 13, but showing a gutter clip temporarily captivated by the clip controller.
Figure 16:
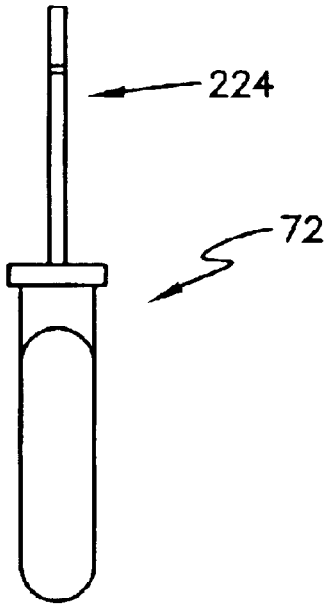
FIG. 16 is a rear elevational view of the clip controller.
Figure 18:
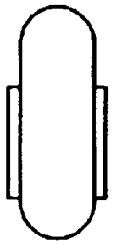
FIG. 18 is a top plan view of the clip controller.
Figure 15:
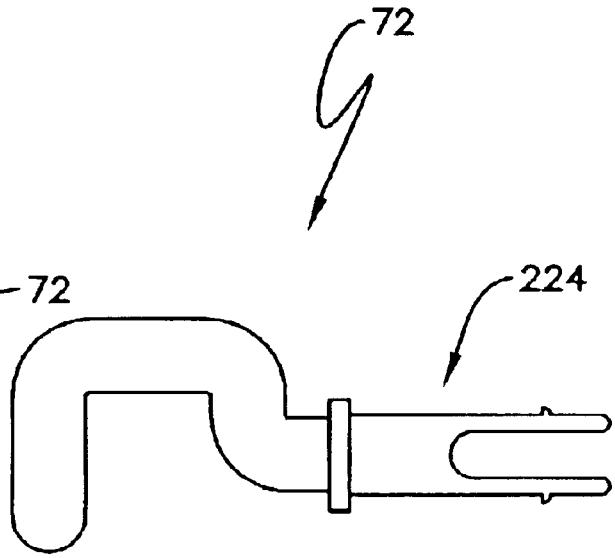
FIG. 15 is a right side elevational view of the clip controller, the left side comprising a mirror image thereof.
Figure 17:
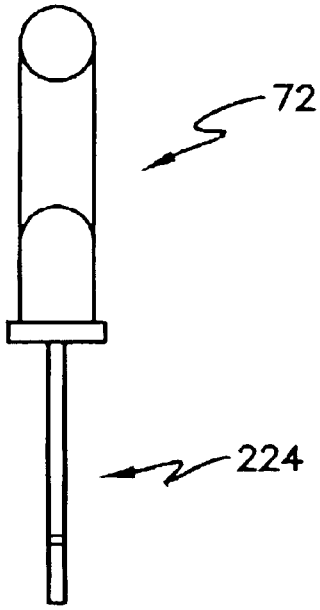
FIG. 17 is a front elevational view of the clip controller.

The upper body 220 (FIG. 12) of each clip controller 72 comprises a rigid, generally C-shaped structure comprising a base 230, a lower elbow 232, a vertical spacer 234, an intermediate elbow 235, and an integral, control prong 236, which terminates in a convex point 238. Prong 236 penetrates the clip control regions 127 (FIG. 10) and/or 168 (FIG. 21) when captivating a gutter clip 60 or adhesive clip 66 respectively. Prong 236 is firmly grasped by the cradle of the clip being installed, so the clip may be turned to a desired control orientation, as illustrated in FIG. 14. Once a clip is "loaded," pole 64 elevates the clip into the proximity of either a gutter or other structure to for attachment. Once a clip is installed, sideways movement of the pole will transversely withdraw the prong 236 from the clip, which will remain firmly attached as intended by the installer.

Figure 11:
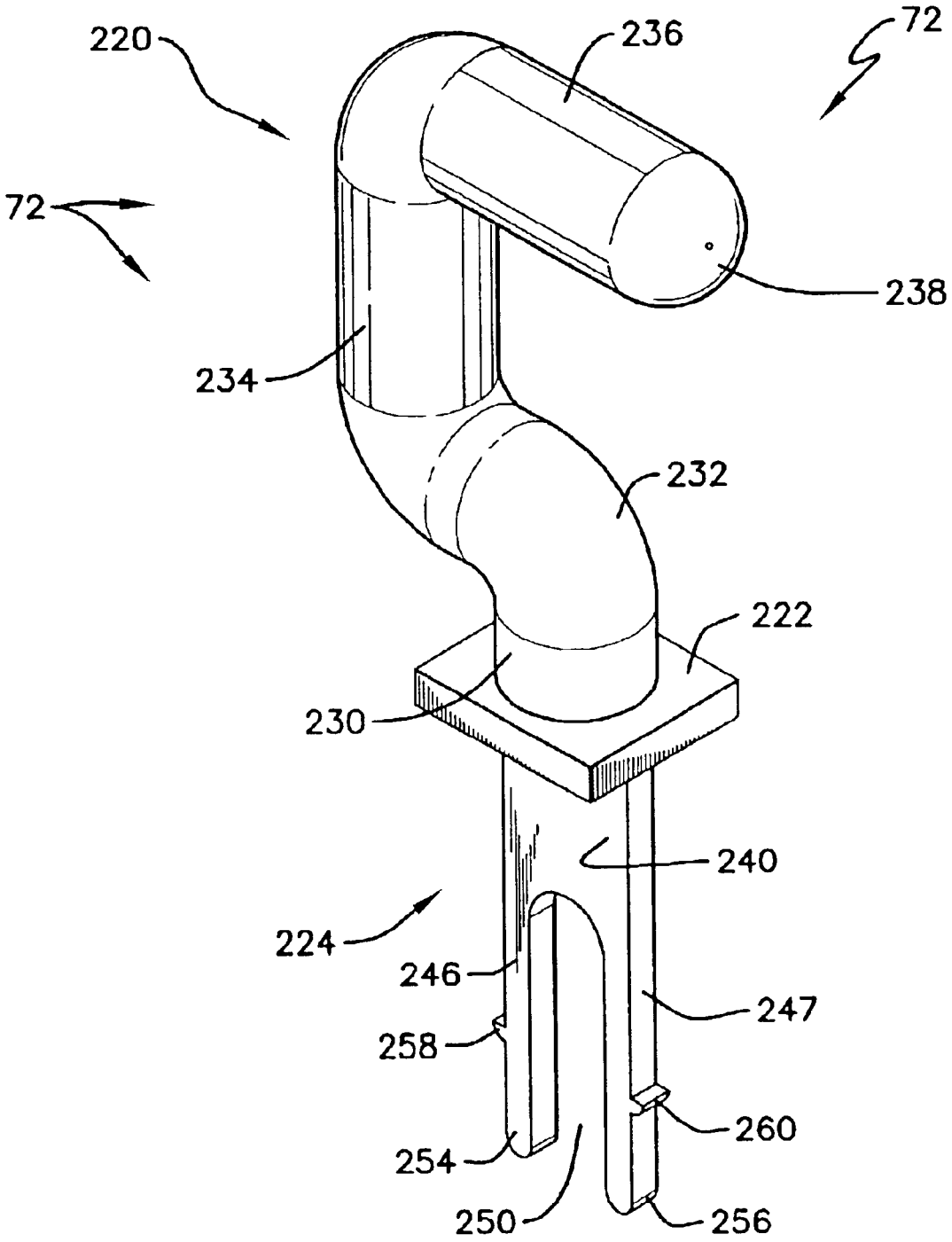
FIG. 11 is an enlarged, isometric view of the preferred clip controller tool.
Figure 12:
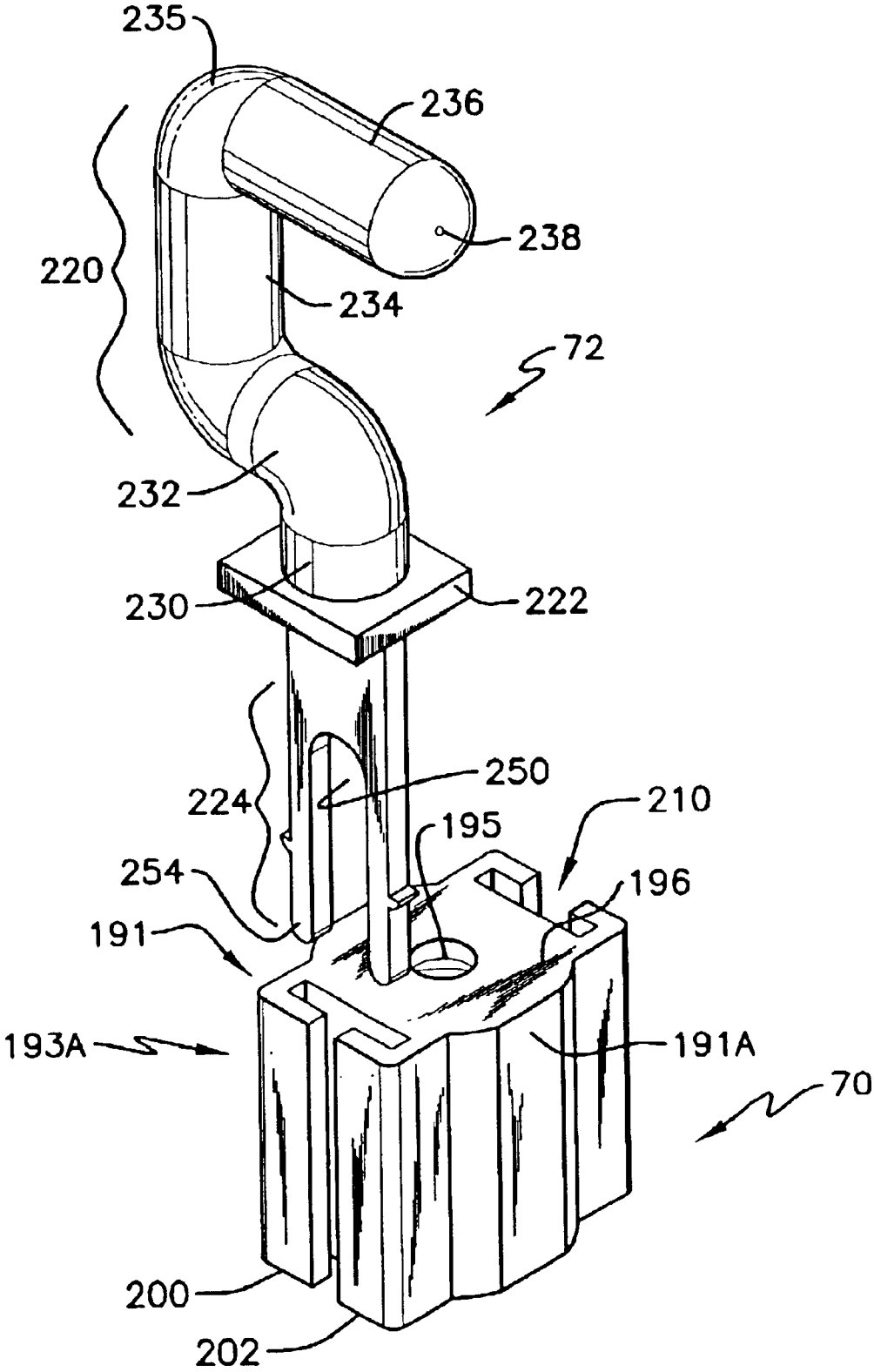
FIG. 12 is an exploded isometric view showing the clip controller tool in a moved position immediately prior to insertion into the preferred installation tool.

Fork 224 (FIGS. 11–13) facilitates coupling of the clip controller 72 to the nut 70. Each fork 224 comprises a web 240 projecting downwardly from the center of plate 222. Web 240 is divided into a pair of elongated, and spaced apart legs 246, 247 (FIG. 11). There is an elongated, generally rectangular clearance slot 250 (FIG. 12) defined between legs 246, 247 so that they may yieldably deflect towards one another when the fork is mated to the installation nut 70 (FIG. 12, 13). Legs 246, 247 terminate in lowermost terminal feet 254, 256 (FIG. 11) respectively. Each leg has an integral, laterally-outwardly projecting, detent 258, 260 (FIG. 11) located above its foot 254, or 256.

Figure 13:
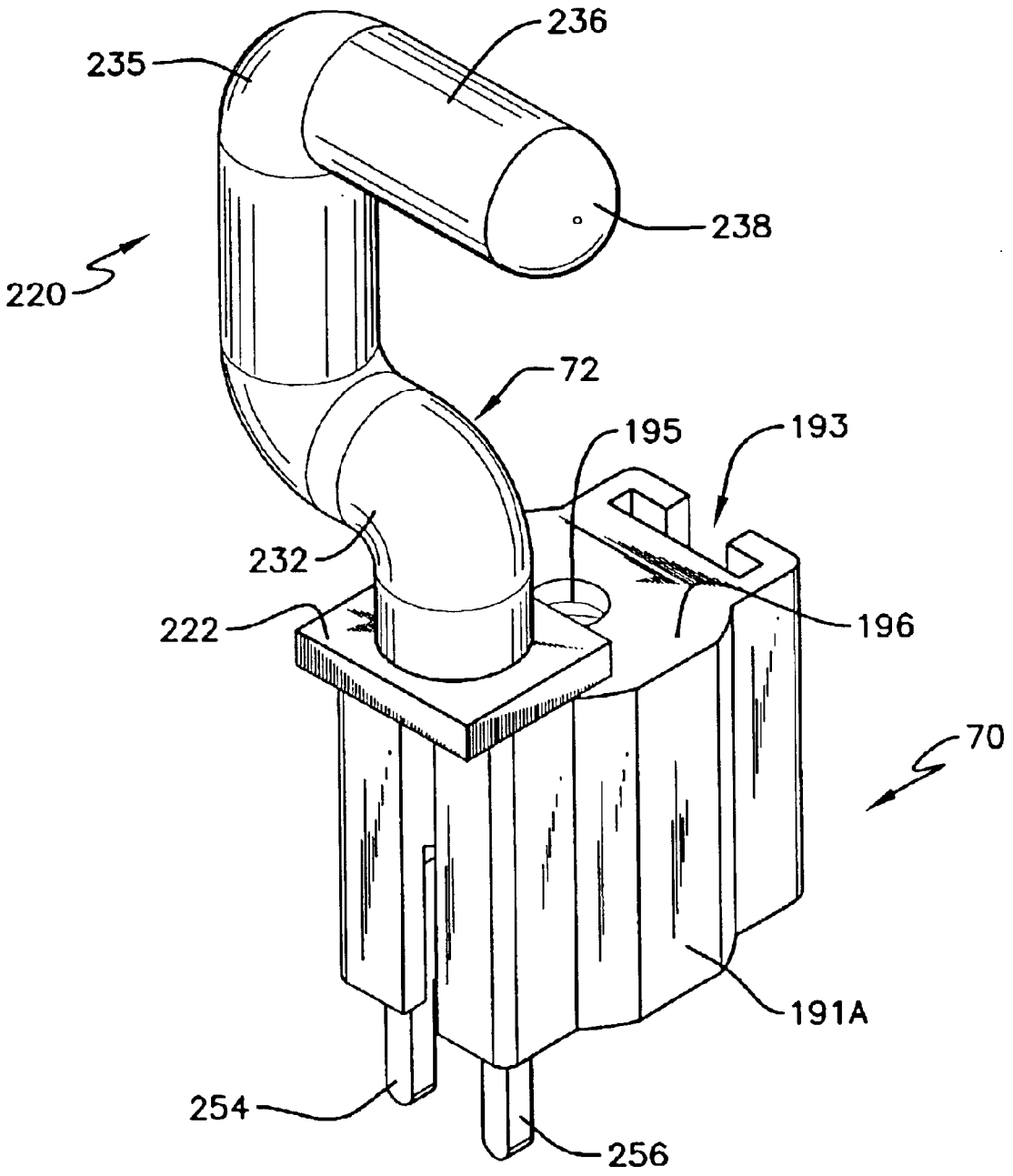
FIG. 13 is an isometric view showing the clip controller tool fitted to the installation tool.

To mount a clip controller, the fork 224 is inserted within the T-shaped slot 210 at a selected side of a selected nut 70. As best seen in FIG. 11–14, the fork feet 254, 256 clear the entrance point and slide within the slot 210. As the twin detents 258, 260 enter the lateral confines of the slot 210, they will compress the fork legs together. Fork 224 may slide downwardly through the slot 210 until, as seen in FIG. 13, plate 222 contacts and then rests firmly against top 196 of the nut 70. As the fork legs become fully inserted within nut 70, feet 254 and 256 will eventually project out of nut 70 (FIG. 13). When a maximum travel position is reached, detents 258, 260 will "pop out" of the channel, and the fork feet 254, 256 will spring apart and assume their "normal" uncompressed orientation. In this position, the clip controller 72 will be yieldably prevented from withdrawing from nut 70, as the detents 258, 260 (FIG. 11) will clear slot 210, and yieldably block withdrawal by contacting the underside of nut 70. (The same detent concept is employed with the wire tool discussed later illustrated fully in FIG. 28). To withdraw the clip controller 72, the fork feet 254 and 256 emanating from the underside of nut 70 (i.e., as seen best in FIG. 13) are simply pinched together. Concomitantly, as detents 258, 260 are deflected inwardly, they will clear the edges of slot 210 so fork legs 246, 247 may be drawn upwardly into slot 210 as the controller 72 is pulled vertically upwardly to escape nut 70.

Figure 38:
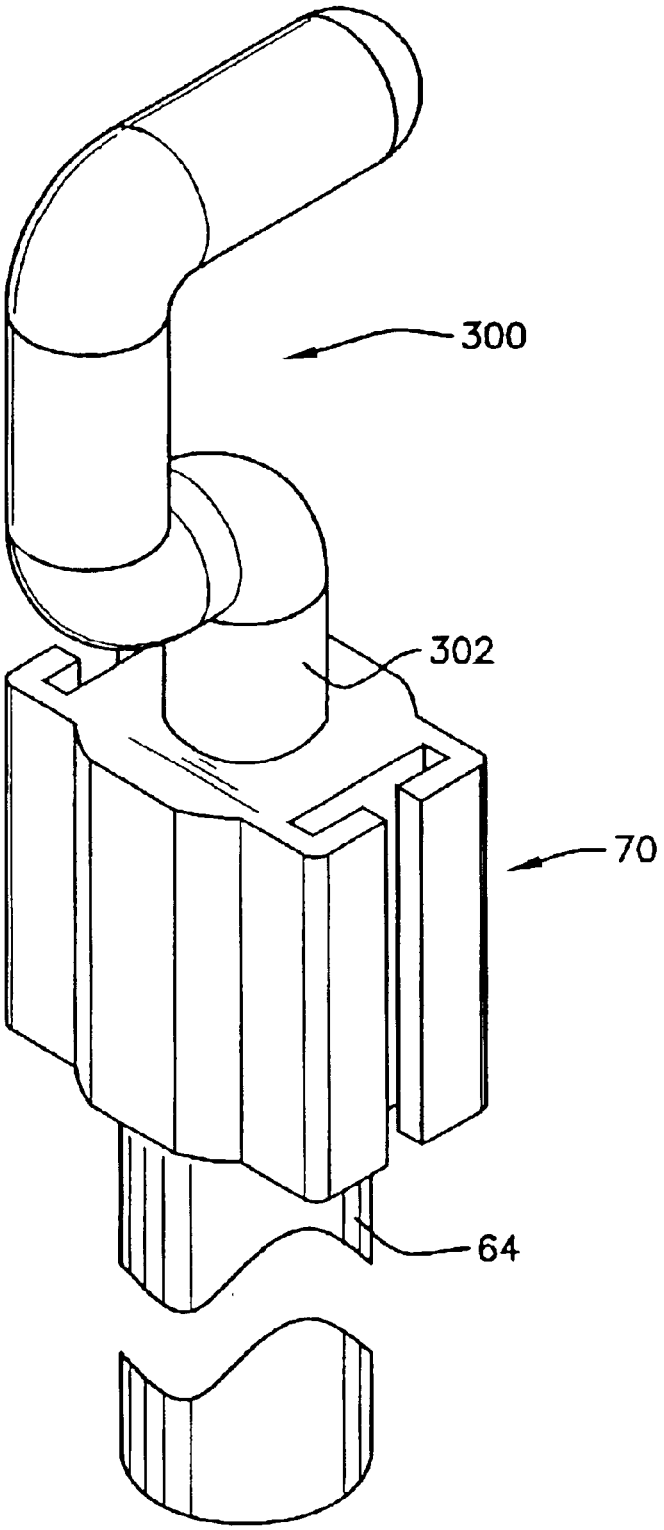

An alternative clip controller 300 (FIG. 38) is attached to the installation nut 70 slightly differently. In this case the lower segment 302 has a threaded bore which is mated to bolt 76 (FIG. 35) so that the clip controller 300 is threadably secured to the nut 70.

Figure 27:
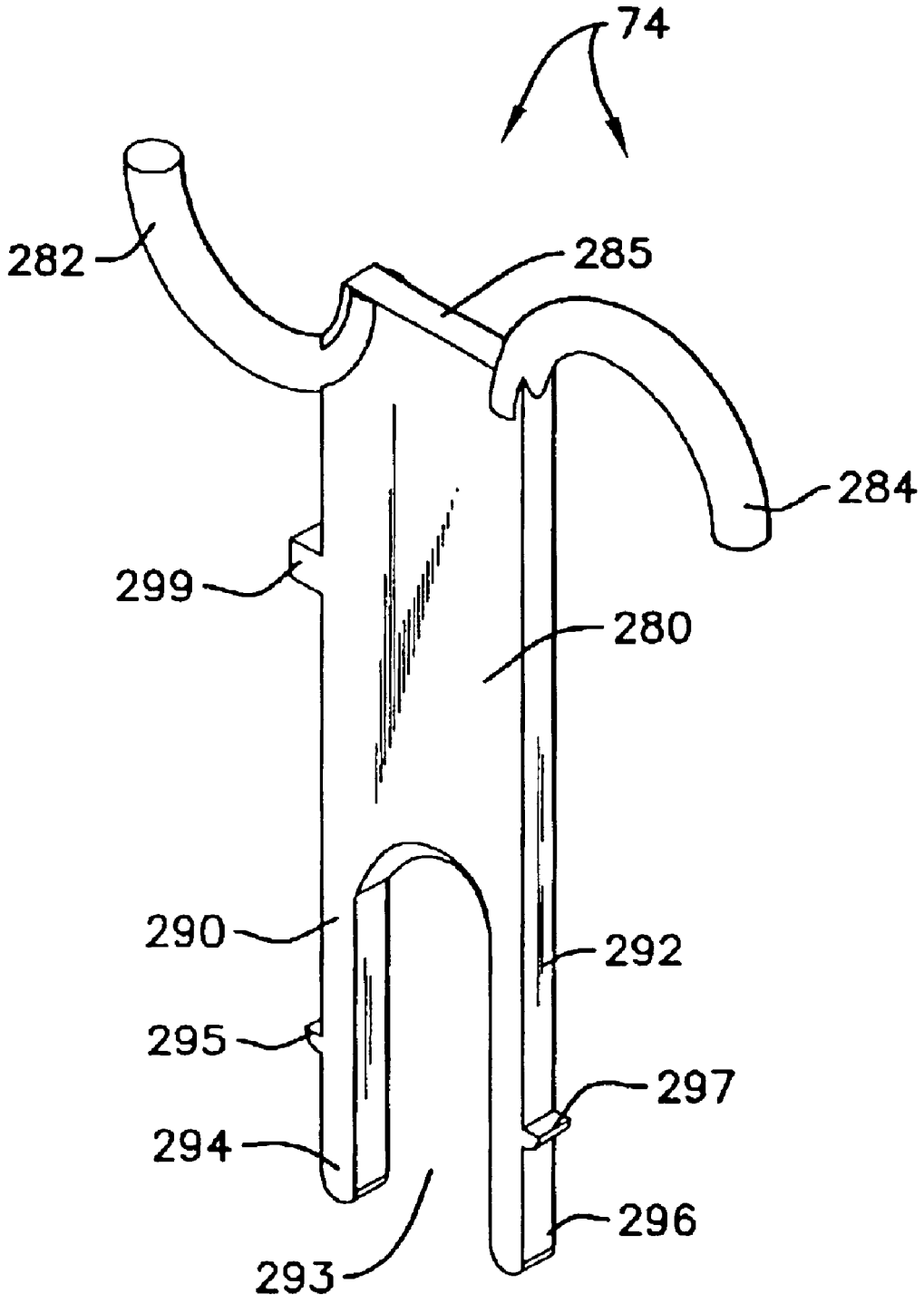
FIG. 27 is an enlarged, frontal isometric view of the preferred wire tool.
Figure 28:
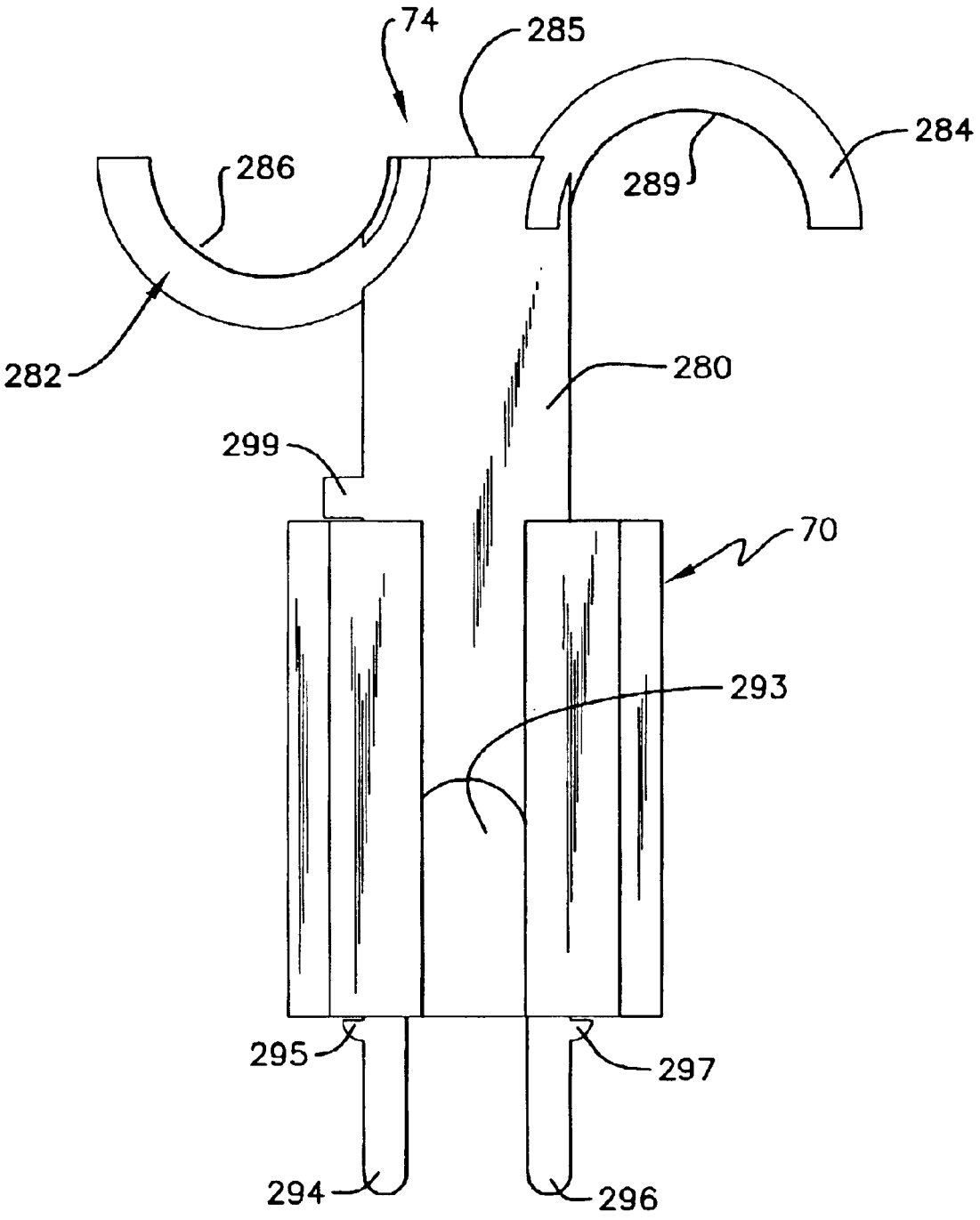
FIG. 28 is an enlarged, elevational view of the wire tool inserted and seated within the installation receptacle.

With reference now directed to FIGS. 27–30, the wire tool 74 is also designed to be snap-fitted to the installation nut 70. It is preferably injection molded from nylon. Wire tool comprises an elongated, generally rectangular body 280 provided with a pair of spaced-apart, oppositely-bowed and curved arms 282 and 284 emanating from top 285. Arm 282 presents an upwardly facing, concave recess 286, whereas the similarly-shaped but oppositely directed recess 289 formed by arm 284 faces downwardly. Body 280 terminates in a pair of spaced apart legs 290, 292 (FIG. 27) disposed on opposite sides of an open clearance slot 293. Legs 290, 292 have integral feet 294, 296 below the integral, laterally outwardly projecting detents 295, 297 (FIGS. 27, 28). One edge of the wire tool 74 comprises a laterally outwardly projecting stop 299, which limits travel of the tool when coupled to the installation nut 70.

Figure 30:
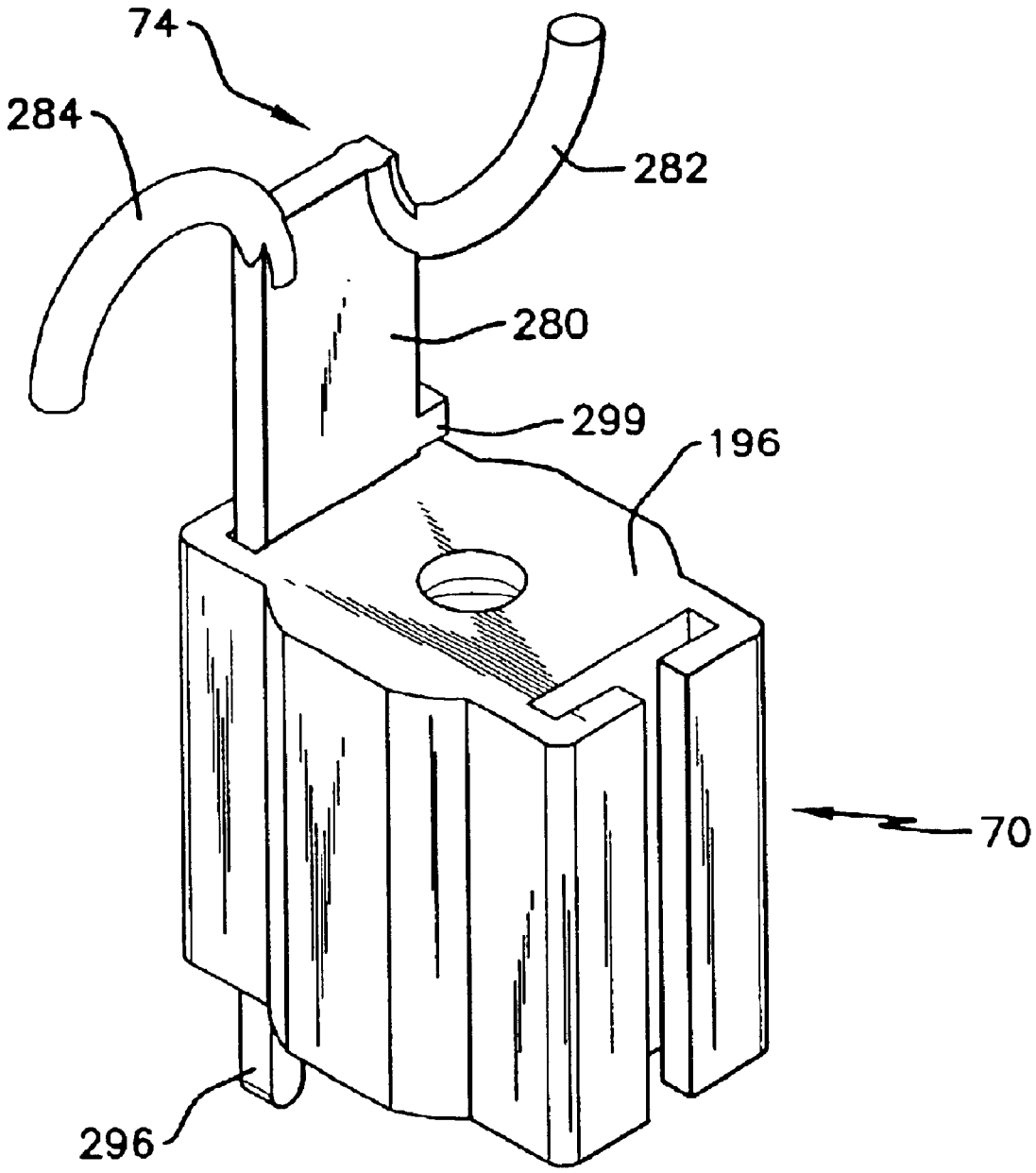
FIG. 30 is an isometric view of the wire tool inserted and seated within the installation receptacle nut.
Figure 31:
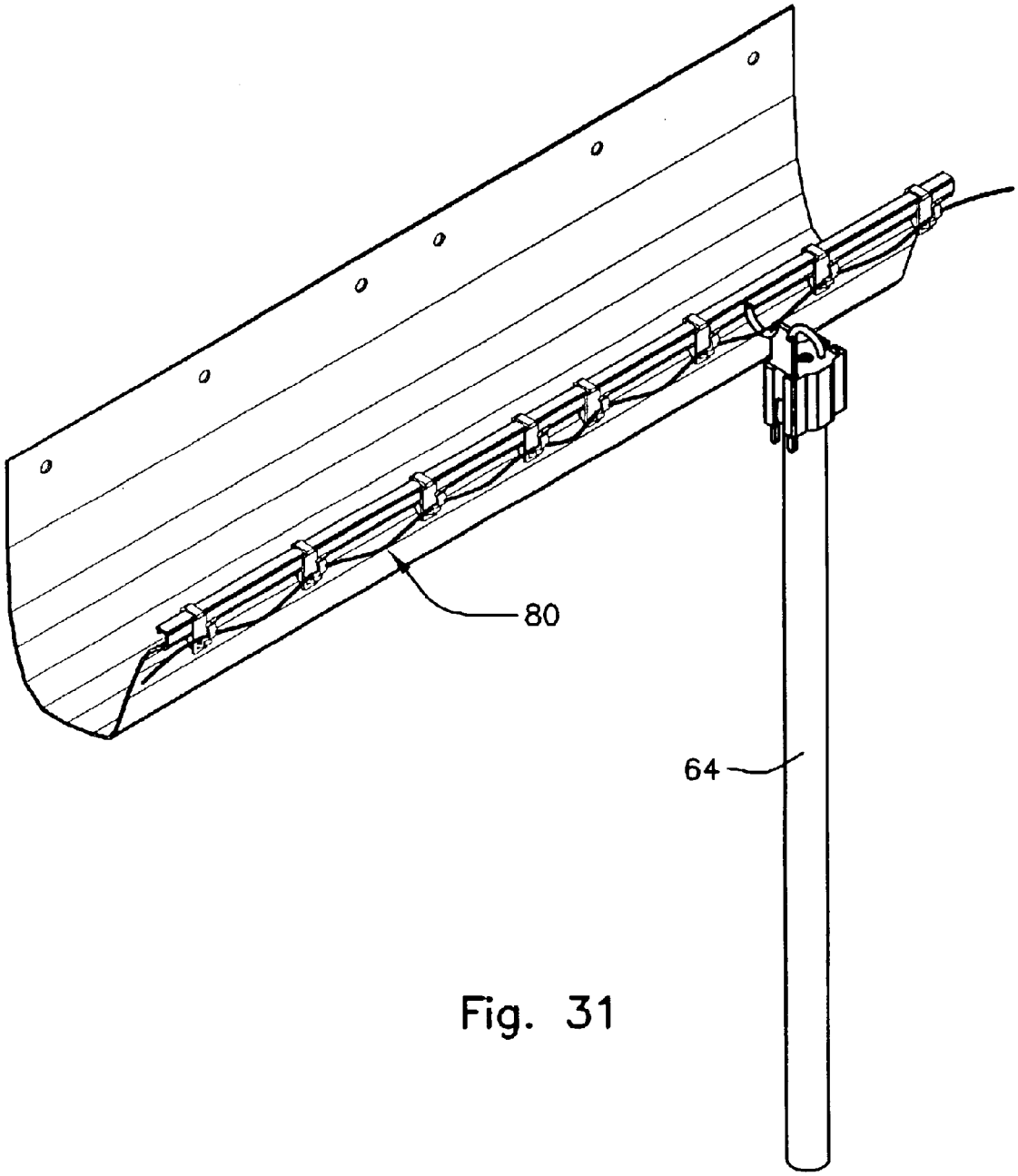
FIG. 31 is a fragmentary, diagrammatic and pictorial view illustrating the deployment of wiring to a plurality of previously mounted gutter clips.

Wire tool 74 is coupled to or removed from installation nut 70 in much the same manner as clip controller 72 discussed above. As seen most clearly in FIGS. 28 and 30, feet 294 and 296 may be inserted into slot 210 and slidably forced therewithin. The twin detents 295, and 297 will pinch the legs 290, 292 (FIG. 27) slightly together when they enter slot 210. Tool 74 may slide downwardly into nut 70 through slot 210 until the stop 299 abuts the upper surface 196 of nut 70 (FIGS. 28, 30). At this maximum deflection point, feet 294 and 296 project out of nut 70 (FIG. 28) at the bottom. After maximum displacement, detents 295, 297 will pop apart after escaping slot 210 to snap-fit tool 74 to nut 70. In the "installed" position, tool 74 will be yieldably prevented from withdrawing from nut 70, as the spread-apart detents 295, 297 (FIG. 28) block withdrawal by contact with the underside of nut 70. To withdraw tool 74, the feet 294 and 296 at the underside of nut 70 (FIG. 28) are simply pinched together, deflecting detents 295, 297 together to clear the edges of slot 210 enabling upward travel of tool 74 until it escapes nut 70.

Figure 37:
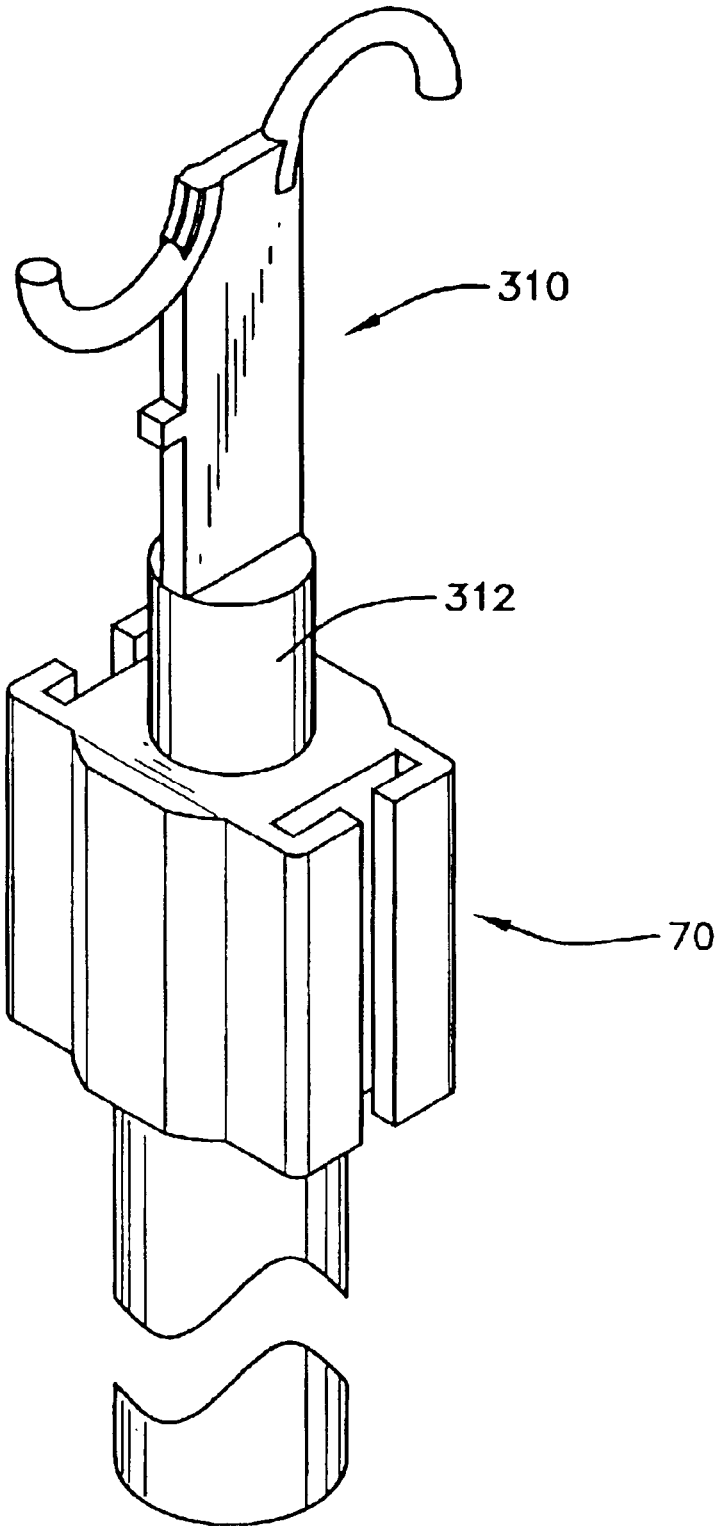
FIG. 37 is an isometric view of an alternative embodiment wherein a modified wire tool is screw-attached to the preferred nut; and, FIG. 38 is an isometric view of an alternative embodiment wherein a modified clip controller is screw-attached to the preferred nut.

An alternative wire installation tool 310 (FIG. 37) is threadably coupled to and retained by a nut 70. It's integral base portion 312 has an internal, threaded bore that mates with bolt (FIG. 35).

From the foregoing, it will be seen that this invention is one well adapted to obtain all the ends and objects herein set forth, together with other advantages that are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A kit for installing decorative wiring at selected, elevated positions upon an available gutter, said kit comprising:

an elongated pole for manipulation from a stable position beneath an area upon which said decorative wiring is to be installed;

at least one resilient gutter clip adapted to be installed upon the gutter for supporting the wiring, each gutter clip comprising:

an integral, projecting latch terminating in a barb for engaging the gutter when the gutter clip is installed; and, an integral, cradle for supporting said wiring, said cradle comprising at least one arcuate segment defining a control region;

at least one clip controller for engaging said gutter clip control region for temporarily holding and manipulating and installing the gutter clip;

means controlled by said pole for at least temporarily, releasably mounting said clip controller to said pole; and, at least one wiring tool for applying said wiring within previously mounted gutter clips, said wiring tool releasably, temporarily controlled by said pole and comprising a pair of oppositely bowed arms for manipulating said wiring.

2. The kit as defined in claim 1 wherein said means for at least temporarily, releasably mounting said clip controller comprises a nut removably attached to said pole.

3. The kit as defined in claim 1 further comprising a plurality of adhesive clips adapted to be pressed against flat surfaces and stuck thereto by said clip controller for mounting said wiring.

4. The kit as defined in claim 3 wherein each adhesive clip comprises a central baseplate, an adhesive layer formed on said baseplate, and an integral, cradle extending angularly, outwardly from said baseplate for holding wiring.

5. The kit as defined in claim 4 wherein each adhesive clip cradle comprises an arcuate segment defining a control region between itself and said baseplate, and wherein the clip controller frictionally engages said control region to mount said adhesive clips.

6. The kit as defined in claim 5 wherein said adhesive clip arcuate segment originates from the baseplate and terminates in an integral, projecting tab defining a throat for admitting wiring between itself and the baseplate, the wiring supported within said control region.

7. The kit as defined in claim 1, wherein:

said means controlled by said pole for at least temporarily, releasably mounting said clip controller comprises a nut adapted to be coupled to said pole, the nut comprising at least one captivation slot; and, the clip controller comprises a pair of elongated, spaced apart legs adapted to be inserted within the nut captivation slot.

8. The kit as defined in claim 7 wherein each clip controller leg comprises detent means for first yieldably urging the clip controller legs together when forced into the nut captivation slot, and for snapping apart when the clip controller legs are fully inserted to yieldably maintain the clip controller engaged with the nut.

9. The kit as defined in claim 1, wherein:

said means controlled by said pole for at least temporarily, releasably mounting said clip controller comprises a nut adapted to be coupled to said pole, the nut comprising at least one captivation slot; and, said wiring tool comprises a pair of elongated, spaced-apart legs adapted to be inserted within the nut captivation slot.

10. The kit as defined in claim 9 wherein each wiring tool comprises detent means for first yieldably urging the wiring tools legs together when forced into the nut captivation slot, and for snapping apart when the wiring tool legs are fully inserted to yieldably maintain the wiring tool engaged with the nut.

11. The kit as defined in claim 10 wherein the wiring tool comprises a laterally outwardly projecting stop for limiting downward travel of the wiring tool when coupled to the nut.

12. A kit for installing decorative wiring at selected, elevated positions upon an available gutter, said kit comprising:

an elongated pole for manipulation from a stable position beneath an area upon which said wiring is to be installed;

at least one resilient gutter clip adapted to be installed upon the gutter for supporting the wiring, each gutter clip comprising:

an integral, projecting latch terminating in a barb for engaging the gutter when the gutter clip is installed; and, an integral, angularly extending cradle for supporting said wiring, said cradle comprising at least one arcuate segment defining a control region;

at least one clip controller for temporarily holding and manipulating a gutter clip to be installed;

nut means threadably coupled to said pole for at least temporarily, releasably mounting said clip controller; and, at least one wiring tool for installing said wiring within previously mounted clips, said wiring tool controlled by said nut means and comprising a pair of integral, oppositely bowed arms for manipulating wiring.

13. The kit as defined in claim 12 further comprising a plurality of adhesively-backed adhesive clips adapted to be pressed against flat surfaces and stuck thereto by said clip controller for holding wiring upon flat surfaces.

14. The kit as defined in claim 13 wherein each adhesive clip comprises a cradle with an arcuate segment defining a control region, and wherein the clip controller frictionally engages said control region to mount said adhesive clips.

15. The kit as defined in claim 12 wherein:

said nut means comprises at least one captivation slot; and, said clip controller comprises a pair of elongated, spaced apart legs adapted to be inserted within the nut means captivation slot.

16. The kit as defined in claim 15 wherein each clip controller leg comprises detent means for first yieldably urging the clip controller legs together when forced into the nut means captivation slot, and for snapping apart when the clip controller legs are fully inserted to yieldably maintain the clip controller engaged with the nut means.

17. The kit as defined in claim 12 wherein:

said nut means comprises at least one captivation slot; and, said wiring tool comprises a pair of elongated, spaced-apart legs adapted to be inserted within the nut means captivation slot.

18. The kit as defined in claim 17 wherein each wiring tool comprises detent means for first yieldably urging the wiring tools legs together when forced into the nut means captivation slot, and for snapping apart when the wiring tool legs are filly inserted to yieldably maintain the wiring tool engaged with the nut means.

19. A kit for installing decorative wiring at selected, elevated positions, the kit comprising an elongated pole;

a plurality of resilient gutter clips for engaging a gutter if available and for thereafter supporting the decorative wiring, each of said gutter clips comprising:

an integral, upper barb for engaging a gutter when installed; and, an integral, arcuate cradle for supporting said wiring, said cradle comprising a control region;

a plurality of adhesively-backed adhesive clips adapted to be pressed against flat surfaces for holding wiring, each adhesive clip comprising an arcuate cradle defining a control region;

at least one wiring tool for installing wiring within previously mounted clips;

clip controller means for installing clips, said clip controller means fictionally engaging the control region of a clip to be installed; and, installation nut means adapted to be coupled to said elongated pole for mounting and operating said clip controller means and said wiring tool.

20. The kit as defined in claim 19 wherein:

the nut means comprises at least one captivation slot;

the clip controller means comprises a pair of elongated, spaced apart legs adapted to be inserted within the captivation slot, each leg comprising detent means for first yieldably urging the clip controller means legs together when forced into the nut captivation slot, and for snapping apart when the legs are filly inserted to yieldably maintain the controller means engaged with the nut means; and, said wiring tool comprises a pair of elongated, spaced-apart legs adapted to be inserted within the captivation slot, each leg comprising detent means for first yieldably urging the wiring legs together when forced into the captivation slot, and for snapping apart when the wiring tool legs are fully inserted to yieldably maintain the wiring tool engaged with the nut means.

21. A kit for installing decorative wiring comprising one or more strings of lights at selected, elevated positions adjacent a roof line or upon a gutter or upon other preselected available, exposed flat surfaces, the kit comprising:

a plurality of resilient gutter clips for engaging the gutter and thereafter supporting the decorative wiring, each of said gutter clips comprising:

a projecting latch terminating in a barb for engaging the gutter when installed; and, an integral cradle extending angularly away from the latch for supporting said wiring, said cradle comprising at least one arcuate segment defining a control region;

a plurality of resilient, adhesive clips adapted to be pressed against flat surfaces and stuck thereto for holding said wiring, each of said adhesive clips comprising:

an integral, projecting cradle for supporting wiring, said cradle comprising at least one arcuate segment defining a control region; and, a peel-and-stick adhesive backing at the rear of said adhesive clip enabling the adhesive clip to be stuck to a flat surface;

clip controller means for installing either gutter clips or adhesive clips, said controller means comprising a projecting prong for frictionally engaging the control region of said gutter clips and/or said adhesive clips for temporarily holding and forcibly manipulating them during installation;

wiring tool means for manipulating said decorative wiring and installing said wiring within previously mounted clips;

installation nut means adapted to be coupled to an elongated pole for mounting and operating said clip controller means and/or said wiring tool means, said nut means comprising means for at least temporarily, releasably mounting said clip controller means and/or the wiring tool means.

22. A kit for installing decorative wiring comprising one or more strings of lights at selected, elevated positions adjacent a roof line or upon a gutter or upon other preselected available, exposed flat surfaces, the kit comprising:

a plurality of resilient gutter clips for engaging the gutter and thereafter supporting the decorative wiring, each of said gutter clips comprising:

a baseplate;

an integral, upper latch projecting away from one side of the baseplate and terminating in a barb for engaging the gutter when installed; and, an integral cradle extending angularly away from an opposite side of said baseplate for supporting said wiring, said cradle comprising at least one arcuate segment defining a control region between itself and the baseplate;

a plurality of resilient, adhesively-backed clips adapted to be pressed against flat surfaces and stuck thereto for holding said wiring, each of said adhesive clips comprising:

a baseplate having a front and rear;

an integral cradle extending angularly away from the baseplate front for supporting wiring, said cradle comprising at least one arcuate segment defining a control region between itself and the baseplate; and, a peel-and-stick adhesive backing formed on a rear of said baseplate of said adhesive clip enabling the adhesive clip to be stuck to a flat surface;

clip controller means for installing either gutter clips or adhesive clips, said controller means comprising a projecting prong for frictionally engaging the control region of said gutter clips and/or said adhesive clips for temporarily holding and forcibly manipulating them during installation;

wiring tool means for manipulating said decorative wiring and installing said wiring within previously mounted clips;

installation nut means adapted to be coupled to an elongated pole for mounting and operating said clip controller means and/or said wiring tool means, said nut means comprising means for at least temporarily, releasably mounting either said clip controller means and/or the wiring tool means.

23. An installer for stringing decorative wiring, said installer comprising elongated pole means for operating the installer from a stable position beneath an area upon which said wiring is to be installed;

gutter clip means comprising a plurality of resilient gutter clips to be snap fitted to an available gutter for supporting the decorative wiring, each gutter clip comprising:

a baseplate having a pair of sides;

an integral, upper latch projecting away from one side of the baseplate and terminating in a barb for engaging the gutter; and, an integral, arcuate cradle extending away from an opposite side of said baseplate for supporting said wiring, said cradle defining a control region between itself and the baseplate;

clip controller means for mounting said gutter clip means by engaging said control region; and, installation nut means for attachment to said pole means for releasably mounting said clip controller means; and, wiring tool means for manipulating said decorative wiring and installing said wiring within previously mounted clips, said wiring tool means adapted to be releasably, temporarily mounted by said nut means.

24. The installer as defined in claim 23 wherein said installation nut means comprises captivation slot means defined between a pair of opposed, generally planar retaining arms that face one another across a central gap for receiving at least a portion of said clip controller means.

25. The installer as defined in claim 23 further comprising peel and stick clip means for mounting upon flat surfaces to hold wiring, said peel and stick means comprising a plurality of adhesive clips adapted to manipulated by said clip controller means.

26. The installer as defined in claim 23 wherein:

said nut means comprises at least one captivation slot; and, said clip controller means comprises a control prong for releasably engaging the control region of a clip to be installed and a pair of legs adapted to be inserted within the nut means captivation slot, each leg comprising detent means for first yieldably compressing the clip controller means legs together when forced into the captivation slot, and for snapping apart when the legs are fully inserted.

27. The installer as defined in claim 23 wherein:

said nut means comprises at least one captivation slot: and, said wiring tool means comprises a pair of legs adapted to be inserted within the nut means captivation slot, each wiring tool means leg comprising detent means for first yieldably urging the legs together when forced into the captivation slot, and for snapping apart when the legs are fully inserted.

28. An installer for mounting decorative wiring, the installer comprising a plurality of resilient gutter clips for engaging a gutter and thereafter supporting the decorative wiring, each of said gutter clips comprising:

a baseplate;

an integral, upper latch projecting away from one side of the baseplate and terminating in a barb for engaging the gutter when installed; and, an integral cradle associated with an opposite side of said baseplate for supporting said wiring, said cradle comprising at least one arcuate segment defining a control region between itself and the baseplate;

clip controller means for installing clips, said controller means comprising a projecting prong for frictionally engaging said gutter clip control region for temporarily holding and manipulating a clip during installation; and, installation nut means adapted to be coupled to an elongated pole for mounting and operating said clip controller means, said nut means comprising slot means for at least temporarily, releasably captivating at least a portion of the said clip controller means.

29. The installer as defined in claim 28 further comprising wiring tool means for manipulating said decorative wiring and installing said wiring within previously mounted gutter clips, said wiring tool means comprising a pair of elongated, spaced-apart legs adapted to be inserted within said slot means, each leg comprising detent means for first yieldably urging the legs together when forced into the slot means, and for snapping apart when the legs are fully inserted to yieldably maintain the wiring tool means engaged with the nut means.

30. An installer for installing decorative wiring comprising one or more strings of lights at selected, elevated positions adjacent a roof line or upon a gutter or upon other preselected available, exposed flat surfaces, the installer comprising:

a plurality of resilient gutter clips for engaging the gutter and thereafter supporting the decorative wiring, each of said gutter clips comprising:

a projecting latch terminating in a barb for engaging the gutter when installed; and, an integral cradle for supporting said wiring, said cradle comprising at least one arcuate segment defining a control region;

a plurality of resilient, adhesively-backed clips adapted to be pressed against flat surfaces and stuck thereto for holding said wiring, each of said adhesive clips comprising:

an integral, projecting cradle for supporting wiring, said cradle comprising at least one arcuate segment defining a control region; and, a peel-and-stick adhesive backing on each of said adhesively-backed clips for enabling them to be stuck to a flat surface;

clip controller means for installing either gutter clips or adhesively-backed clips, said controller means comprising a projecting prong for frictionally engaging the control region of said gutter clips and/or said adhesively-backed clips for temporarily holding and forcibly manipulating them during installation;

wiring tool means for manipulating said decorative wiring and installing said wiring within previously mounted clips;

installation nut means adapted to be coupled to an elongated pole for mounting and operating said clip controller means and/or said wiring tool means, said nut means comprising means for at least temporarily, releasably mounting said clip controller means and/or the wiring tool means.

31. An installer for installing decorative wiring comprising one or more strings of lights at selected, elevated positions adjacent a roof line or upon a gutter or upon other preselected available, exposed flat surfaces, the installer comprising:

elongated pole means deployable by a user for operating said installer;

a plurality of resilient gutter clips for engaging the gutter and thereafter supporting the decorative wiring, each of said gutter clips comprising:

a baseplate;

an integral, upper latch projecting away from one side of the baseplate and terminating in a barb for engaging the gutter when installed; and, an integral cradle extending angularly away from an opposite side of said baseplate for supporting said wiring, said cradle comprising at least one arcuate segment defining a control region between itself and the baseplate;

a plurality of resilient, adhesively-backed clips adapted to be pressed against flat surfaces and stuck thereto for holding said wiring, each of said adhesive clips comprising:

a baseplate having a front and rear;

an integral cradle extending angularly away from the baseplate front for supporting wiring, said cradle comprising at least one arcuate segment defining a control region between itself and the baseplate; and, a peel-and-stick adhesive backing formed on a rear of said baseplate of said adhesive clip enabling the adhesive clip to be stuck to a flat surface;

clip controller means for installing either gutter clips or adhesive clips, said controller means comprising a projecting prong for frictionally engaging the control region of said gutter clips and/or said adhesive clips for temporarily holding and forcibly manipulating them during installation;

wiring tool means for manipulating said decorative wiring and installing said wiring within previously mounted clips;

installation nut means adapted to be threadably coupled to said elongated pole means for mounting and operating said clip controller means and/or said wiring tool means, said nut means comprising means for at least temporarily, releasably mounting either said clip controller means and/or the wiring tool means.

32. An installer for installing decorative wiring comprising one or more strings of lights at selected, elevated positions adjacent a roof line or upon a gutter or upon other preselected available, exposed flat surfaces, the installer comprising:

elongated pole means deployable by a user for operating said installer;

a plurality of resilient gutter clips for engaging the gutter and thereafter supporting the decorative wiring, each of said gutter clips comprising:

a baseplate;

an integral, upper latch projecting away from one side of the baseplate and terminating in a barb for engaging the gutter when installed; and, an integral cradle extending angularly away from an opposite side of said baseplate for supporting said wiring, said cradle comprising at least one arcuate segment defining a control region between itself and the baseplate;

a plurality of resilient, adhesively-backed clips adapted to be pressed against flat surfaces and stuck thereto for holding said wiring, each of said adhesive clips comprising:

a baseplate having a front and rear;

an integral cradle extending angularly away from the baseplate front for supporting wiring, said cradle comprising at least one arcuate segment defining a control region between itself and the baseplate; and, a peel-and-stick adhesive backing formed on a rear of said baseplate of said adhesive clip enabling the adhesive clip to be stuck to a flat surface;

clip controller means for installing either gutter clips or adhesive clips, said controller means comprising a projecting prong for frictionally engaging the control region of said gutter clips and/or said adhesive clips for temporarily holding and forcibly manipulating them during installation, and said clip controller means comprising downwardly projecting legs;

wiring tool means for installing said wiring within previously mounted clips, said wiring tool means comprising downwardly projecting legs and a pair of oppositely bowed arms for manipulating said decorative wiring; and, installation nut means adapted to be coupled to said elongated pole for mounting and operating said clip controller means and/or said wiring tool means, said nut means comprising slot means for at least temporarily, releasably captivating said legs associated with either said clip controller means and/or the wiring tool means.

* * * * *